US008837971B2

(12) United States Patent
Kemmochi et al.

(10) Patent No.: US 8,837,971 B2
(45) Date of Patent: Sep. 16, 2014

(54) IMAGE FORMING APPARATUS

(71) Applicant: Canon Kabushiki Kaisha, Tokyo (JP)

(72) Inventors: Kazuhisa Kemmochi, Suntou-gun (JP); Taichi Takemura, Abiko (JP); Hikaru Osada, Kamakura (JP); Keisuke Abe, Yokohama (JP); Tsutomu Miki, Komae (JP); Jiro Ishiduka, Moriya (JP); Toshinori Nakayama, Kashiwa (JP); Masayuki Tamaki, Toride (JP); Satoru Nitobe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 13/705,698

(22) Filed: Dec. 5, 2012

(65) Prior Publication Data

US 2013/0089349 A1 Apr. 11, 2013

Related U.S. Application Data

(63) Continuation of application No. PCT/JP2012/066555, filed on Jun. 28, 2012.

(30) Foreign Application Priority Data

Jul. 15, 2011 (JP) ..... 2011-156393
Jun. 26, 2012 (JP) ..... 2012-143137

(51) Int. Cl.
*G03G 15/20* (2006.01)
*G03G 15/01* (2006.01)

(52) U.S. Cl.
CPC ..... *G03G 15/2064* (2013.01); *G03G 15/0126* (2013.01)
USPC ..... 399/67; 399/328

(58) Field of Classification Search
USPC ..... 399/38, 42, 67–70, 320, 328–334
See application file for complete search history.

(56) References Cited

U.S. PATENT DOCUMENTS 5,761,573 A * 6/1998 Haneda et al. ..... 399/66
7,162,187 B2 * 1/2007 Koichi et al. ..... 399/252

FOREIGN PATENT DOCUMENTS

| | | | |
|---|---|---|---|
| JP | 9-237003 | A | 9/1997 |
| JP | 2002-156858 | A | 5/2002 |
| JP | 2002-296947 | A | 10/2002 |
| JP | 2004-029563 | A | 1/2004 |
| JP | 2004-295144 | A | 10/2004 |
| JP | 2005-195670 | A | 7/2005 |
| JP | 2005-195674 | A | 7/2005 |
| JP | 2007-079234 | A | 3/2007 |
| JP | 2007-133327 | A | 5/2007 |
| JP | 2007-226009 | A | 9/2007 |

* cited by examiner

*Primary Examiner* — Hoan Tran
(74) *Attorney, Agent, or Firm* — Canon USA Inc IP Division

(57) ABSTRACT

An image forming apparatus includes an image forming unit that forms an unfixed toner image on a recording material and a fixing unit, wherein, in a case where an image is formed by using the toners of the plurality of colors, when a specific gravity of the toners is ρ (g/cm$^3$) and a weight average particle diameter of the toners is L (μm), the image forming unit sets a maximum laid-on amount A (mg/cm$^2$) of each color in the unfixed toner image on the recording material so as to satisfy the following condition: $A<\rho\pi L/30\sqrt{3}$, and wherein the fixing unit fixes the unfixed toner image to the recording material so that a dot spread amount (μm) of the toner image satisfies the following condition: $\sqrt{(\rho\pi L^3/90\sqrt{3}A)}\leq$Dot Spread Amount.

16 Claims, 33 Drawing Sheets

FIG. 30

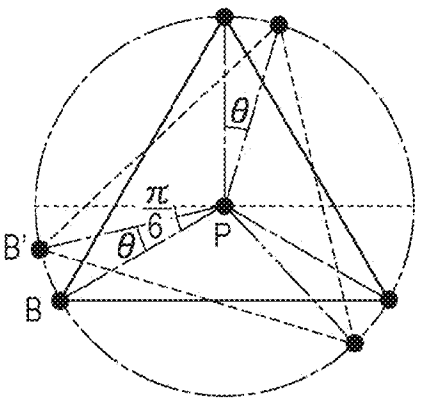

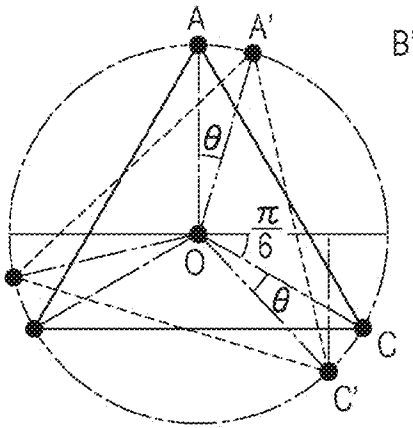

$O\ (0,0)$ $A\left(0, -\frac{L}{\sqrt{3}}\right)$ $A'\left(\frac{L}{\sqrt{3}}\sin\theta, -\frac{L}{\sqrt{3}}\cos\theta\right)$ $P\left(\frac{3}{2}R, \frac{\sqrt{3}}{2}R\right)$ $B\left(\frac{3}{2}R - \frac{L}{\sqrt{3}}\cos\left(\frac{\pi}{6}\right), \frac{\sqrt{3}}{2}R - \frac{L}{\sqrt{3}}\sin\left(\frac{\pi}{6}\right)\right)$ $B'\left(\frac{3}{2}R - \frac{L}{\sqrt{3}}\cos\left(\frac{\pi}{6} - \theta\right), \frac{\sqrt{3}}{2}R - \frac{L}{\sqrt{3}}\sin\left(\frac{\pi}{6} - \theta\right)\right)$ $O\ (0,0)$ $C\left(\frac{L}{\sqrt{3}}\cos\left(\frac{\pi}{6}\right), -\frac{L}{\sqrt{3}}\sin\left(\frac{\pi}{6}\right)\right)$ $C'\left(\frac{L}{\sqrt{3}}\cos\left(\frac{\pi}{6} + \theta\right), -\frac{L}{\sqrt{3}}\sin\left(\frac{\pi}{6} + \theta\right)\right)$

MICRORUBBER HARDNESS TESTER MD-1

SECTIONAL VIEW OF HEATING ROLLER 500

ANOTHER RUBBER HARDNESS TESTER

IMAGE FORMING APPARATUS

CROSS-REFERENCE TO RELATED APPLICATIONS

This application is a Continuation of International Patent Application No. PCT/JP2012/066555, filed Jun. 28, 2012, which claims the benefit of Japanese Patent Application No. 2011-156393, filed Jul. 15, 2011 and No. 2012-143137, filed Jun. 26, 2012, all of which are hereby incorporated by reference herein in their entirety.

BACKGROUND OF THE INVENTION

1. Field of the Invention

The present invention relates to an image forming apparatus, such as a copier or a printer, including a fixing device that fixes an unfixed toner image to a recording material, the unfixed toner image being formed on the recording material by using, for example, electrophotographic recording technology.

2. Description of the Related Art

With the development of related technologies and increasing market requirements, methods of visualizing image information, such as an electrophotographic method, by forming an electrostatic latent image have been used in various fields, such as the fields of copiers and printers.

In particular, in recent years, there have been increasing demands for environmental protection and cost reduction, and technologies for reducing toner consumption have become extremely important. The technologies for reducing toner consumption are also important from the viewpoint of reducing the energy generated in the process of permanently fixing toner to a recording material. In particular, in electrophotographic image forming apparatuses used in offices, these technologies play an important role in complying with energy saving requirements.

PTL 1 to PTL 3 describe technologies in which toner having high tinting power is used and the amount of toner transferred onto the recording material is reduced so that a toner image in the fixed state has the required image density.

CITATION LIST

Patent Literature

PTL 1 Japanese Patent Laid-Open No. 2004-295144
PTL 2 Japanese Patent Laid-Open No. 2005-195670
PTL 3 Japanese Patent Laid-Open No. 2005-195674

However, the above-described technologies of the related art cannot solve the following problems. That is, although the amount of consumption of the toner may be reduced by increasing the amount of pigment contained in the toner and reducing the total toner laid-on amount, when the toner laid-on amount is reduced, the amount of toner in a single-color solid image is reduced and it becomes difficult for toner particles to adhere to each other. When a recording material having an irregular surface is used, the surface cannot be covered by the toner. In such a case, image defects such as blurring or formation of blank areas in characters or line drawings will occur.

When an image of a secondary color (color formed by stacking two toner layers of different colors) is formed under such a condition, the area in which the toners of different colors overlap is reduced. Therefore, there is a problem that saturation of the secondary color is significantly reduced and the color reproduction range is narrowed.

SUMMARY OF THE INVENTION

To solve the above-described problems, according to the present invention, an image forming apparatus includes an image forming unit that forms an unfixed toner image, in which toners of a plurality of colors are stacked, on a recording material; and a fixing unit that fixes the unfixed toner image formed on the recording material to the recording material by heating and pressing the unfixed toner image in a fixing nip portion, wherein, in a case where an image is formed by using the toners of the plurality of colors, when a specific gravity of the toners is ρ (g/cm$^3$) and a weight average particle diameter of the toners is L (μm), the image forming unit sets a maximum laid-on amount A (mg/cm$^2$) of each color in the unfixed toner image on the recording material so as to satisfy the following condition:

$$A < \frac{\rho \pi L}{30\sqrt{3}},$$

and wherein the fixing unit fixes the unfixed toner image to the recording material so that a dot spread amount (μm) of the toner image satisfies the following condition:

$$\sqrt{\frac{\rho \pi L^3}{90\sqrt{3} \cdot A}} \leq \text{Dot Spread Amount}$$

Further features of the present invention will become apparent from the following description of exemplary embodiments with reference to the attached drawings.

BRIEF DESCRIPTION OF THE DRAWINGS

FIG. 30 is a third diagram that illustrates the seeping limit.

DESCRIPTION OF THE EMBODIMENTS

The present invention will be further explained with reference to embodiments. Although the embodiments are examples of best modes for carrying out the present invention, the present invention is not limited to the embodiments.

Image Forming Unit

Figure 1:
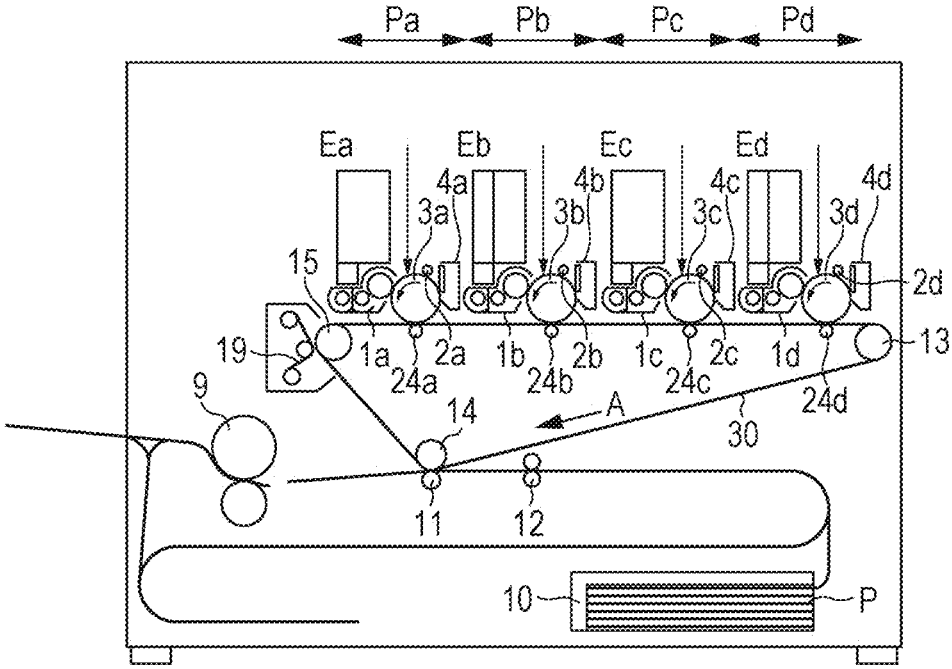
FIG. 1 is a schematic diagram illustrating an example of an image forming apparatus.

First, second, third, and fourth image forming units Pa, Pb, Pc, and Pd are arranged next to each other in an image forming apparatus illustrated in FIG. 1. The image forming units Pa, Pb, Pc, and Pd form toner images of different colors through latent-image forming, developing, and transferring processes.

The image forming units Pa, Pb, Pc, and Pd include dedicated image bearing members, which are electrophotographic photoconductor drums 3*a*, 3*b*, 3*c*, and 3*d*, respectively, in this example. Toner images of respective colors are formed on the photoconductor drums 3*a*, 3*b*, 3*c*, and 3*d*. An intermediate transfer member 30 is disposed adjacent to the photoconductor drums 3*a*, 3*b*, 3*c*, and 3*d*. The toner images of respective colors formed on the photoconductor drums 3*a*, 3*b*, 3*c*, and 3*d* are transferred onto the intermediate transfer member 30 in a first transfer process, and are then transferred onto a recording material P by a second transfer unit. The toner images that have been transferred onto the recording material are fixed to the recording material by being heated and pressed by a fixing unit 9, and are then ejected to the outside of the apparatus as a recorded image.

Drum chargers 2*a*, 2*b*, 2*c*, and 2*d*, developing devices 1*a*, 1*b*, 1*c*, and 1*d*, first transfer chargers 24*a*, 24*b*, 24*c*, and 24*d*, and cleaners 4*a*, 4*b*, 4*c*, and 4*d* are arranged around the outer peripheries of the photoconductor drums 3*a*, 3*b*, 3*c*, and 3*d*, respectively. A laser scanner used to form electrostatic latent images on the photoconductor drums in accordance with image information are arranged above the above-mentioned components.

Cyan, magenta, yellow, and black toners are contained in the developing devices 1*a*, 1*b*, 1*c*, and 1*d*. The developing devices 1*a*, 1*b*, 1*c*, and 1*d* develop the latent images on the photoconductor drums 3*a*, 3*b*, 3*c*, and 3*d*, respectively, and visualize the latent images as a cyan toner image, a magenta toner image, a yellow toner image, and a black toner image.

The intermediate transfer member 30 is rotated in the direction shown by the arrow at the same peripheral speed as a peripheral speed of each photoconductor drum 3. The toner image of the first color, which is yellow, is formed on the photoconductor drum 3*a* and is transferred onto the outer peripheral surface of the intermediate transfer member 30 by the effect of a first transfer bias applied to the intermediate transfer member 30 when the toner image passes through a nip portion between the photoconductor drum 3*a* and the intermediate transfer member 30. Similarly, the toner image of the second color, which is magenta, the toner image of the third color, cyan, and the toner image of the fourth color, black, are successively transferred onto the intermediate transfer member 30 in a superimposed manner. As a result, a synthesized color toner image that corresponds to a desired color image is formed on the intermediate transfer member.

A second transfer roller 11 is disposed in contact with the intermediate transfer member 30. A desired second transfer bias is applied to the second transfer roller 11 by a second transfer bias source. The synthesized color toner image formed by transferring the toner images onto the intermediate transfer member 30 in a superimposed manner is transferred onto the recording material P that has been conveyed from a paper cassette 10 to a nip portion between the intermediate transfer member 30 and the second transfer roller 11 through resist rollers 12. Thus, an unfixed toner image in which toners of a plurality of colors are stacked is formed on the recording material. Subsequently, the recording material is conveyed to the fixing unit 9. The unfixed toner image formed on the recording material is fixed to the recording material by being heated and pressed in a fixing nip portion of the fixing unit 9.

After the first transfer process, the photoconductor drums 3*a*, 3*b*, 3*c*, and 3*d* are cleaned by their respective cleaners 4*a*, 4*b*, 4*c*, and 4*d*. The intermediate transfer member 30 is also cleaned by a cleaner 19.

Fixing Device

The fixing device (fixing unit) 9 according to this example continuously applies a shear force to the toner image in a constant direction that is perpendicular to a toner stacking direction while a single recording material is being subjected to the fixing process in the fixing nip portion. The reason for this configuration will now be described.

Dot Spread Amount

Figure 2A:
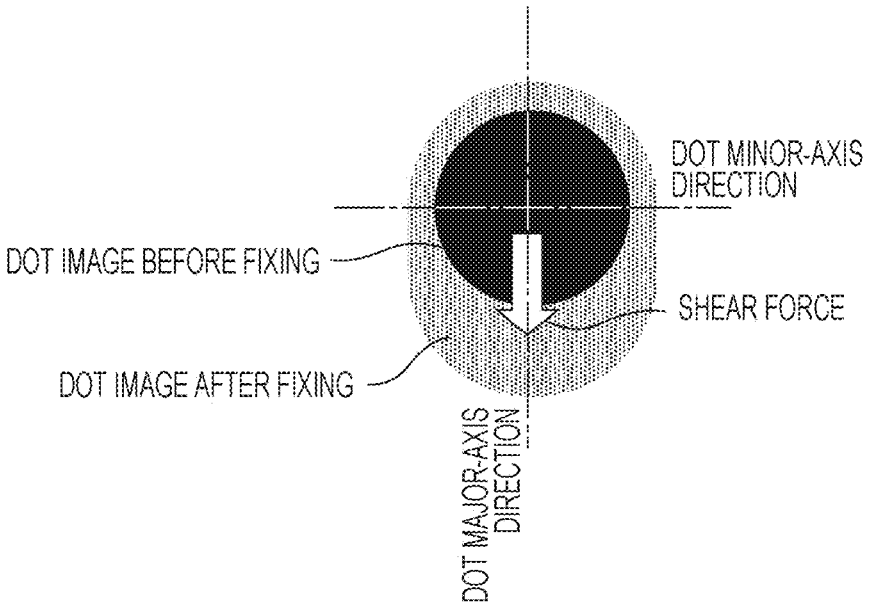
FIGS. 2A and 2B are schematic diagrams illustrating examples of the states of dot images before and after a fixing process.
Figure 2B:
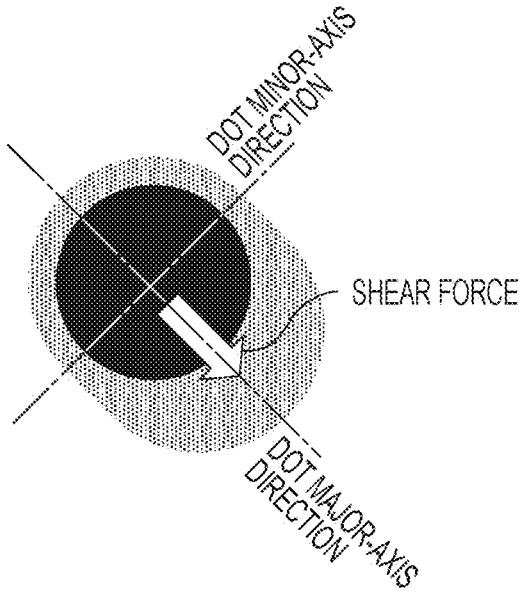

The fixing device according to this example applies a force to the unfixed toner image, the force spreading the toners in an in-plane direction of the recording material (direction parallel to the plane of the recording material) that is perpendicular to the toner stacking direction. This force is referred to as a shear force in this description. Here, "dot spread amount" is defined as an index for evaluating the magnitude of the force. The dot spread amount will be described with reference to FIGS. 2A and 2B. FIGS. 2A and 2B are schematic diagrams illustrating examples of the states of dot images before and after the fixing process is performed by the fixing device according to this example. The black circles show the dot images formed by using the toners before the fixing process. The gray areas show the dot images after the fixing process in which the toners melt and spread. As illustrated in FIGS. 2A and 2B, the fixing device according to this example applies a shear force to the toners in an in-plane direction that is perpendicular to the toner stacking direction so that the dot images largely spread in the in-plane direction in which the shear force is applied.

An index for evaluating the shear force applied by the fixing device according to this example is defined by using the above-described characteristic. That is, first, a substantially circular single-color unfixed dot image (average diameter is about 20 to 100 μm) is formed on the recording material P. Next, the dot image is fixed by the fixing device according to this example which applies a shear force, and a diameter of the fixed image is measured. Since the dot image spreads in the direction of the shear force, a diameter in the major-axis direction (long diameter) and a diameter in the minor-axis direction that is perpendicular to the major-axis direction (short diameter) of the dot image are both measured. A value obtained by subtracting the short diameter from the long diameter is calculated. A similar measurement is performed for a plurality of dot images, and the average of the calculated values is determined as a dot spread amount.

Figure 3:
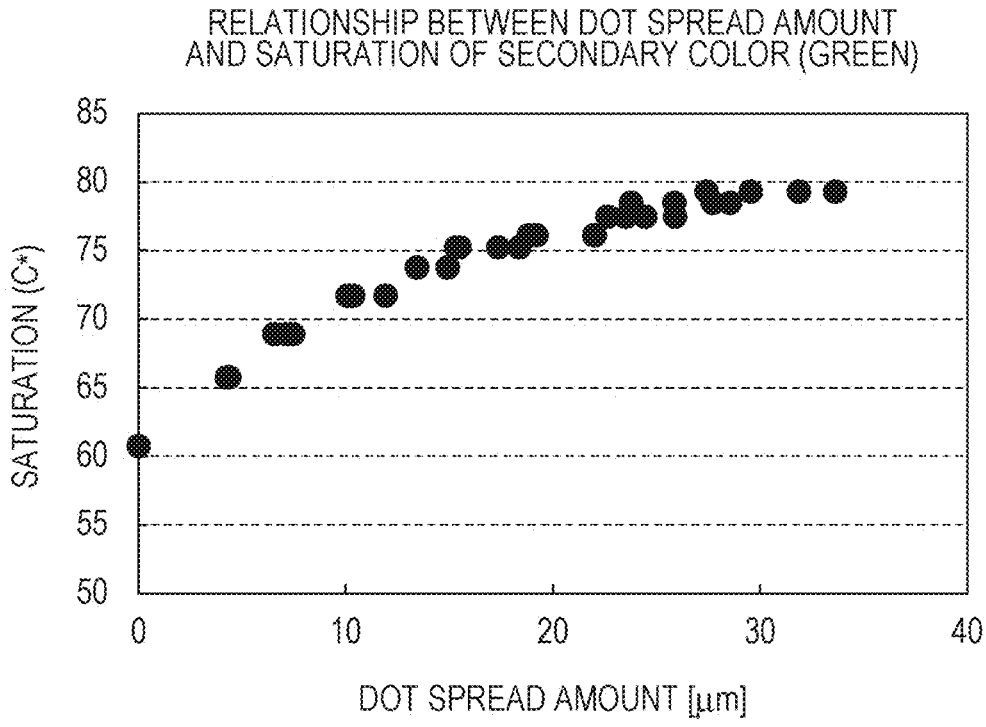
FIG. 3 is a graph showing the relationship between the dot spread amount and saturation of a secondary color (green).

FIG. 3 is a graph showing the relationship between the dot spread amount and the saturation of a secondary color (green). A green image with a saturation of about $c^*=60$ is set as a reference (dot spread amount is 0 μm). The saturation increases as the dot spread amount increases. As the dot spread amount increases, a larger shear force is applied to the toners and the toners more largely spread in a direction parallel to the plane of the recording material to cover the recording material P. In particular, the area in which the toners of different colors overlap to form a secondary color increases, and color developability (saturation) is improved accordingly. For the above-described reason, the dot spread amount is used as an index for evaluating the shear force applied to the unfixed toner image by the fixing device.

Fixing Device According to First Embodiment

A fixing device according to an embodiment will now be described. In the present embodiment, the fixing roller is rotated and moved (slid) in the longitudinal direction of the fixing roller at the same time to spread the toners while the unfixed toners are being melted. Accordingly, even when the amounts of toners in the unfixed state are small (even when the toner layers are thin), the color developability of the secondary color can be increased. This will be described in more detail.

Figure 4:
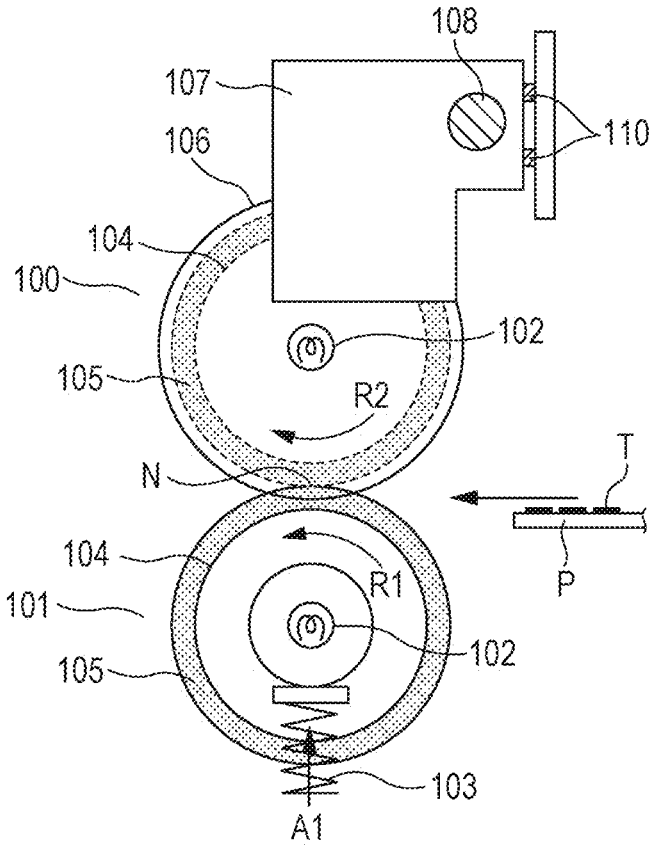
FIG. 4 is a schematic sectional view of a fixing device according to a first embodiment.

FIG. 4 is a schematic sectional view of the fixing device according to the present exemplary embodiment. A fixing roller (first rotating member that comes into contact with the unfixed toner image) 100 has an outer diameter of ϕ40 mm and includes an aluminum core bar 104 having a diameter of ϕ36 mm and an elastic layer 105 that is made of a silicone rubber and formed around the core bar 104. A release layer made of tetrafluoroethylene-perfluoroalkylvinyl ether copolymer (PFA) having a thickness of 30 μm is formed on the elastic layer 105 as a toner release layer. In the present embodiment, a PFA tube having a high durability is used as the release layer. Instead of PFA, a fluorocarbon resin, such as polytetrafluoroethylene (PTFE) or tetrafluoroethylene-hexafluoropropylene resin (FEP), may be used as the material of the release layer.

In the present embodiment, a pressing roller (second rotating member that forms the fixing nip portion together with the first rotating member) 101 has a structure similar to that of the fixing roller 100. Specifically, the outer diameter is ϕ40 mm, and an elastic layer 105 made of a silicone rubber is formed around an aluminum core bar 104 having a diameter of ϕ36 mm. In addition, a release layer made of PFA is provided as the outermost layer. The pressing roller 101 is in contact with the fixing roller by being pressed in the direction shown by arrow A1 at 400 [N] by a compression spring 103, thereby forming a fixing nip portion N whose width in a conveying direction of the recording material is 9 mm. The pressing roller 101 is rotated by a drive motor 1109 (see FIG. 5) in the direction shown by arrow R1 at a surface speed of 117 mm/sec. The fixing roller 100 is also rotated at a surface speed of 117 mm/sec (in the direction shown by arrow R2) by the rotation of the pressing roller 101.

Each of the fixing roller 100 and the pressing roller 101 includes a halogen heater 102 disposed therein. The halogen heaters 102 generate heat when electric power is supplied thereto. The generated heat is transmitted to the core bars 104 owing to heat transfer by radiation or through air. Then, the elastic layers 105 and the release layers are heated. A temperature detection element (not shown) is disposed in contact with a surface of the fixing roller 100, and the electric power supplied to each halogen heater is controlled in accordance with a signal output from the temperature detection element. Thus, the surface temperature of the fixing roller 100 is adjusted.

When the recording material P onto which an unfixed toner image T has been transferred is conveyed to the fixing nip portion N by conveying means (not shown), the heat of the fixing roller 100 is transmitted to the unfixed toner image T and the recording material P, so that the toner image T is fixed to the surface of the recording material P.

Figure 5:
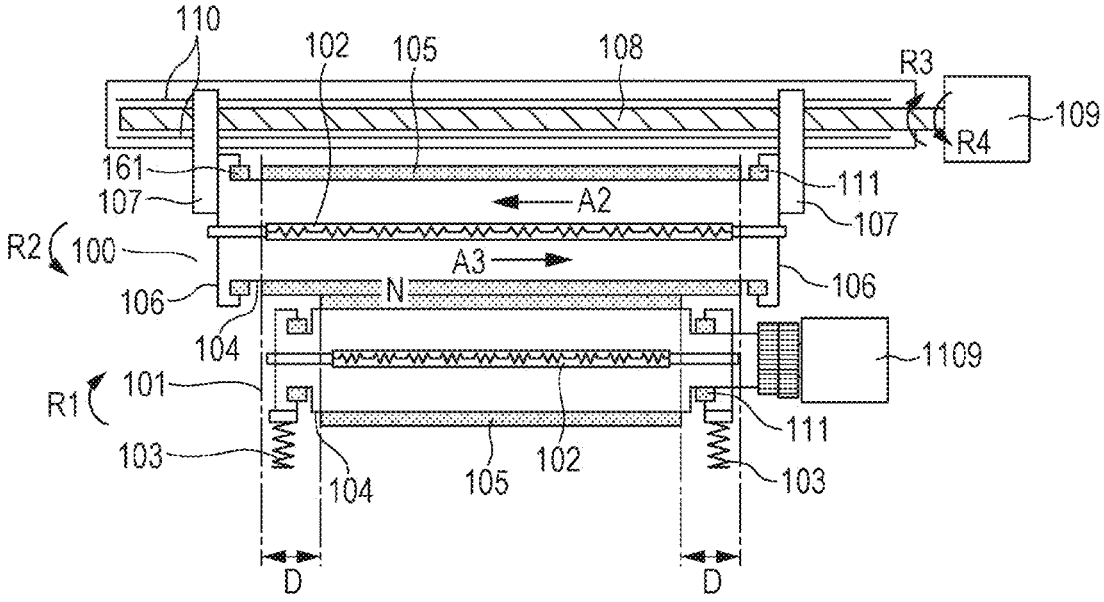
FIG. 5 is a front sectional view of a fixing device in which a fixing roller is caused to slide in a longitudinal direction.

Next, a mechanism for spreading the toners while melting the unfixed toner image T (mechanism for applying a shear force) will be described. FIG. 5 is a front sectional view of the fixing device according to the present embodiment in which the fixing roller is caused to slide in the longitudinal direction. The pressing roller 101 is rotated by the drive motor 1109 in the direction of arrow R1, and the fixing roller 100 is rotated by the rotation of the pressing roller 101 in the direction of arrow R2. Each of the fixing roller 100 and the pressing roller 101 smoothly rotates owing to bearings 111 provided at both ends thereof. The pressing roller 101 is fixed in the longitudinal direction, but the fixing roller 100 is movable (slidable) in the longitudinal direction.

The mechanism for causing the fixing roller 100 to slide in the longitudinal direction will now be described. Side plates 106 are provided at both ends of the fixing roller 100. The side plates 106 are fixed to movable support plates 107. A shaft 108 extends through the movable support plates 107. A motor 109 for rotating the shaft 108 is provided at one end of the shaft 108. When the motor 109 rotates in the direction of arrow R3, the shaft 108 also rotates in the direction of arrow R3. In response to the rotation of the shaft 108, the movable support plates 107 smoothly slide in the direction of arrow A2 along slide rails 110. Therefore, the fixing roller 100, which is fixed to the movable support plates 107, also slides in the direction of arrow A2. When the motor 109 rotates in the reverse direction (direction of arrow R4), the fixing roller 100 slides in the direction of arrow A3 in a manner similar to the above-described case.

The recording material P is caused to pass through the fixing nip portion N while the fixing roller 100 is being rotated and caused to slide in the longitudinal direction as described above. Thus, the unfixed toners on the recording material P are fixed to the recording material P. Even when the fixing roller 100 is caused to slide while the recording material P is passing through the fixing nip portion, the recording material P must be prevented from leaving an area that does not come into contact with the surface layer of the fixing roller 100. Therefore, the length of the fixing roller 100 in the longitudinal direction must be longer than the length of the pressing roller 101 in accordance with the amount by which the fixing roller 100 is caused to slide. As illustrated in FIG. 5, in the present embodiment, the length of the fixing roller 100 is greater than that of the pressing roller 101 by 2D (=D+D). Here, the length D is the distance between an end of the pressing roller 101 and the corresponding end of the fixing roller 100 when the centers of the fixing roller 100 and the pressing roller 101 in the longitudinal direction are aligned. The setting of the length D will be described below.

As described above, when the fixing roller 100 slides in the direction of arrow A2 or arrow A3, the pressing roller 101 is fixed in the longitudinal direction and does not slide. Therefore, the toners on the recording material P receive a shear force in a direction parallel to the movement direction of the fixing roller 100 in the fixing nip portion N. In the case where the fixing roller 100 is not caused to slide in the longitudinal direction, the toners on the recording material receive only a pressing force in a direction perpendicular to the recording material. Therefore, when the amounts of toners are small, the color developability of the secondary color is significantly reduced by the above-described mechanism. In contrast, when the pressing roller 101 is fixed in the longitudinal direction and the fixing roller 100 is caused to slide in the longitudinal direction as in the present embodiment, the toners receive not only the pressing force in the direction perpendicular to the recording material but also a shear force (force that spreads the toners) in a direction parallel to the recording material. Since the toners spread in the longitudinal direction while being melted, even when the amounts of toners are small, the color developability of the secondary color can be increased by the above-described mechanism.

Figure 6:
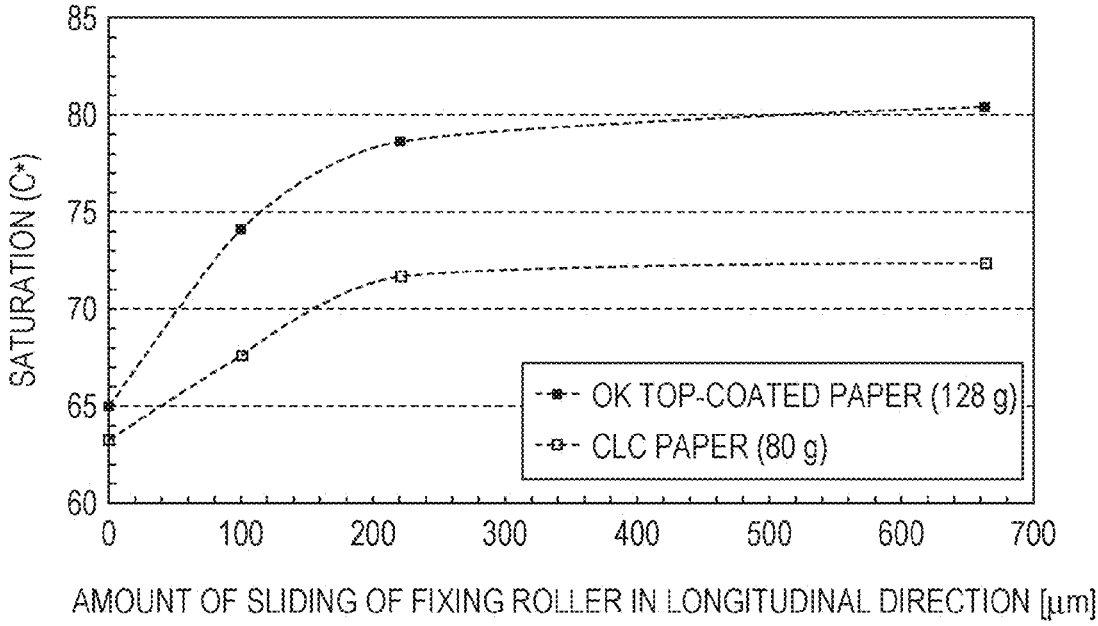
FIG. 6 is a graph showing the relationship between the amount of sliding of the fixing roller and the color developability of green.

FIG. 6 shows the relationship (experimental result) between the color developability (saturation) of a secondary color (green) and the amount by which the fixing roller 100 is caused to slide when the recording material P on which the unfixed toner image is formed passes through the fixing nip portion N. In both of the case in which the recording material P is a sheet of coated paper and the case in which the recording material P is s sheet of normal paper, the color developability increases as the amount of sliding of the fixing roller increases. However, when the amount of sliding is increased beyond a certain value, the saturation gradually approaches a limit. Therefore, a sufficient effect can be obtained when the amount of sliding is set to a value at which the saturation starts to approach the limit. In the experiment of which the result is shown in FIG. 6, the width of the fixing nip portion N was 6.5 mm. Therefore, it was found that the saturation approaches the limit thereof when the amount of sliding is about 3% of the width of the fixing nip portion (about 200 μm). A sufficient saturation-increasing effect can be obtained when the fixing roller 100 is caused to slide 200 μm (about 3% of the width of the fixing nip portion) in the longitudinal direction when the recording material P passes through the fixing nip portion.

Here, it is to be noted that if the sliding direction of the fixing roller 100 is changed while the recording material P is passing through the fixing nip portion N, the fixing roller does not move in the longitudinal direction within a short period of time in which the sliding direction is being changed. As a result, the color developability of a portion of the fixed image in which the sliding direction has been changed will be reduced. Therefore, it is necessary that the sliding direction of the fixing roller 100 be fixed in one direction (A2 direction or A3 direction) while a single recording material P is passing through the fixing nip portion N. In other words, while a single recording material is being subjected to the fixing process in the fixing nip portion, a shear force is preferably continuously applied to the toner image in a constant direction that is perpendicular to the toner stacking direction.

Figure 7:
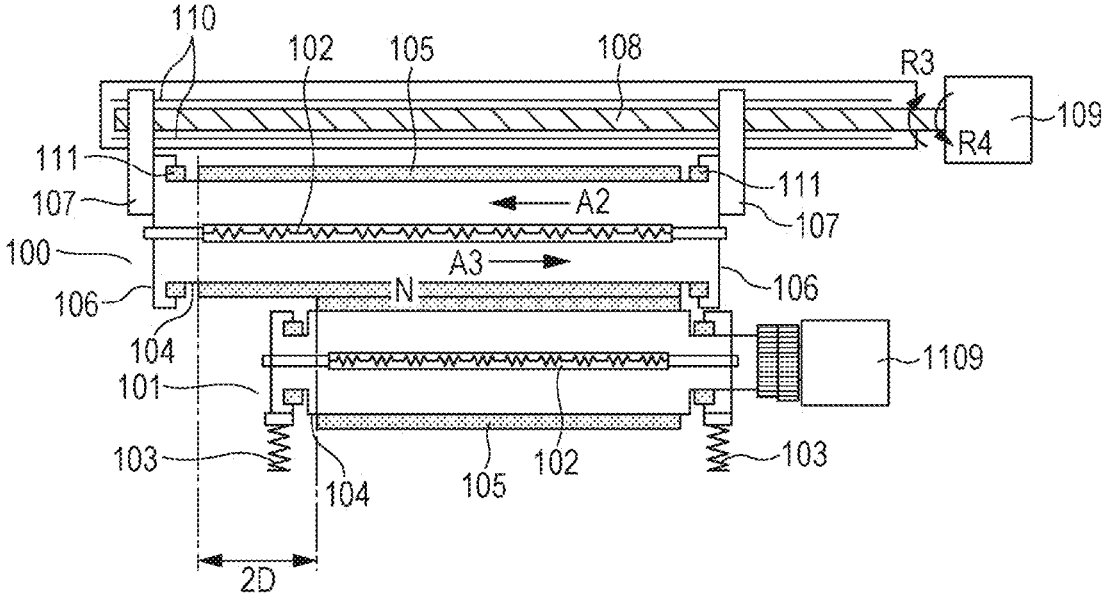
FIG. 7 is a schematic sectional view illustrating the state of the fixing device after a single recording material is subjected to the fixing process.
Figure 8:
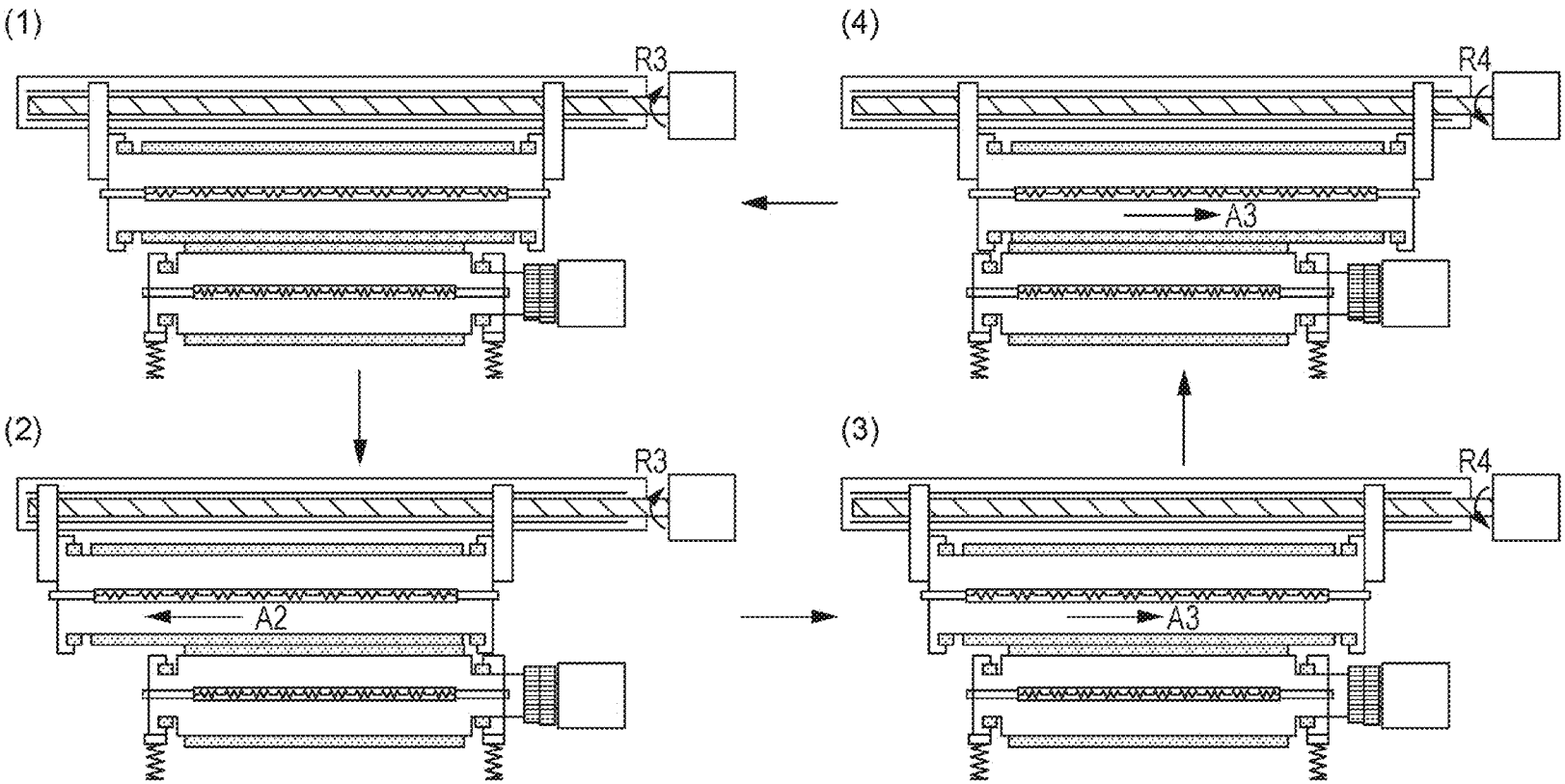
FIG. 8 shows schematic sectional views illustrating a sequence of sliding movements of the fixing roller.

For example, a case will be described in which a horizontally oriented A4-size recording material P passes through the fixing nip portion. For the above-described reason, the required amount of sliding is set to 3% of the width of the fixing nip portion. In this case, the fixing roller 100 slides 6.3 mm (=210 mm×3%) in the direction of arrow A2 (or the direction of arrow A3) from the state illustrated in FIG. 5 while a single horizontally oriented A4-size recording material P passes through the fixing nip portion. The speed at which the fixing roller 100 is caused to slide is 3% of the process speed, and is 3.5 mm/sec (=117 mm/sec×3%) in the present embodiment. FIG. 7 illustrates the state of the fixing device after a single recording material is subjected to the fixing process. In the case where the second recording material is continuously subjected to the fixing process, the fixing roller 100 is caused to slide 6.3 mm in the opposite direction, which is the A3 direction (the A2 direction when the sliding direction was the A3 direction for the first recording material). Thus, the state of the fixing device returns to the state illustrated in FIG. 5. When the third recording material is continuously subjected to the fixing process, the fixing roller 100 may be caused to slide in the A2 direction as in the case of processing the first recording material. However, when a certain portion of the fixing roller 100 in the longitudinal direction always comes into contact with recording materials, that portion quickly deteriorates. Therefore, the fixing roller 100 is preferably caused to slide in the direction of arrow A3 when the third recording material is being processed. FIG. 8 illustrates the above-described sequence of movements of the fixing roller 100. However, the manner in which each recording material P passes through the fixing nip portion N is not illustrated.

Figure 9:
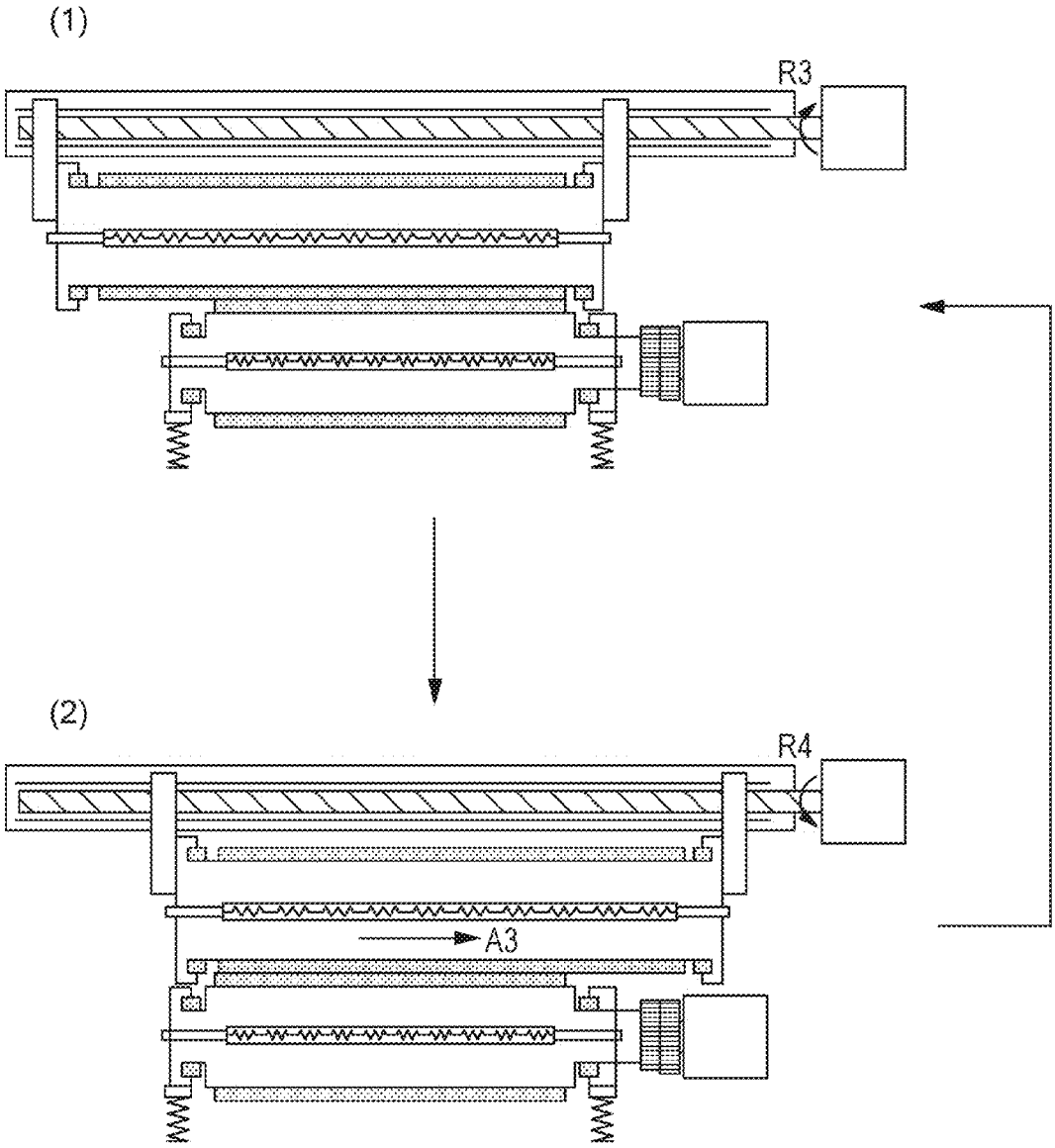
FIG. 9 shows schematic sectional views illustrating a sequence of sliding movements of the fixing roller performed when the second and following recording materials are successively supplied.

When an end of the fixing roller 100 and the corresponding end of the pressing roller 101 are aligned as illustrated in FIG. 7 before the recording material passes through the fixing nip portion, the amount of sliding may be set to 2D at a maximum in the A2 direction. The length D may be set in accordance with the product specifications. In the present embodiment, the maximum width of the recording material that can be used in the image forming apparatus is 19 inches. Therefore, the value of 2D is 14.5 mm (19×25.4 mm×3%), and D is about 7.2 mm. The length of the fixing roller 100 may be greater than that of the pressing roller 101 by the value of 2D. When the size of the recording material is, for example, A4 size, B5 size, letter size, or legal size, the fixing process can be started from the state in which the centers of the fixing roller 100 and the pressing roller 101 are aligned. In other words, the sequential movements illustrated in FIG. 8 can be performed. When the size of the recording material is larger than the above-mentioned sizes and smaller than or equal to 19 inches, the fixing roller 100 is caused to slide in the direction of arrow A3 from the state illustrated in FIG. 7 when the first recording material passes through the fixing nip portion. FIG. 9 illustrates the sequence of movements performed when the second and following recording materials successively pass through the fixing nip portion. Also in FIG. 9, the manner in which each recording material P passes through the fixing nip portion N is not illustrated. In the case where the fixing process is performed in accordance with the above-described procedure, the positional relationship between the fixing roller 100 and the pressing roller 101 must be set to that in part (1) of FIG. 8 or that in part (2) of FIG. 9 in accordance with the size of the recording materials to be subjected to the fixing process before the first recording material passes through the fixing nip portion.

Alternatively, when, for example, the length D is set to 14.5 mm, the recording materials of any size up to 19 inches can be subjected to the fixing process in which the sequential movements illustrated in FIG. 8 are performed. In such a case, the fixing roller 100 and the pressing roller 101 may be arranged such that the centers thereof in the longitudinal direction are aligned after the fixing process. However, the length of the fixing roller 100 in the longitudinal direction is limited by, for example, the space in which the fixing device is arranged. In addition, if the length of the fixing roller 100 is excessively increased, heat radiates from the end portions of the fixing roller and the energy-saving effect is reduced. Therefore, it is necessary to design the sliding means in accordance with the specifications of the product in which the fixing device is installed. Although the amount of sliding is set to 3% of the width of the fixing nip portion in the present embodiment, the amount of sliding may instead be set to less than 3% in accordance with the product specifications or more than 3% in consideration of the effect.

Although the fixing roller 100 is caused to slide in the longitudinal direction in the above-described example, the fixing roller 100 may be fixed in the longitudinal direction and the pressing roller 101 may be caused to slide in the longitudinal direction. In such a case, the fixing roller 100 is driven (rotated) in the circumferential direction and the pressing roller 101 is rotated by the rotation of the fixing roller 100. In addition, since the pressing roller 101 is caused to slide, the length of the pressing roller 101 must be greater than that of the fixing roller 100. The structure is similar to that illustrated in FIG. 5 in a vertically inverted state, and the effects are also similar to the above-described effects. Therefore, detailed explanations are omitted.

According to the above-described examples, one of the fixing roller 100 and the pressing roller 101 is fixed in the longitudinal direction and the other one of the fixing roller 100 and the pressing roller 101 that is not fixed is caused to slide in the longitudinal direction. However, the fixing roller 100 and the pressing roller 101 may both be caused to slide to generate a shear force. If the fixing roller 100 and the pressing roller 101 are caused to slide synchronously in the same direction, no shear force, of course, can be generated and the above-described effects cannot be achieved. The shear force can be generated and effects similar to the above-described effects can be achieved when the fixing roller 100 and the pressing roller 101 are caused to slide in the opposite directions or non-synchronously in the same direction. In the case where one of the fixing roller 100 and the pressing roller 101 is caused to slide, meandering of the recording material occurs when the recording material passes through the fixing nip portion N. However, meandering of the recording material can be suppressed when the fixing roller 100 and the pressing roller 101 are caused to slide by the same amount in the opposite directions.

As described above, when there is a difference between speeds at which the fixing roller 100 and the pressing roller 101 are moved in the longitudinal direction, a shear force is generated in the longitudinal direction in the fixing nip portion N, and the color developability of the secondary color can be increased. Table 1 shows the result of measurements of the chromas a* and b* and saturation c* of patches of a secondary color (green) formed when the sliding operation was not performed and when the sliding operation was performed under the above-described condition (amount of sliding=3% of the width of the fixing nip portion). The measurements were performed by using Spectral densitometer 530 manufactured by X-Rite, Inc.

TABLE 1

| | a* | b* | c* |
|---|---|---|---|
| Sliding Not Performed | −58.4 | 28.6 | 65.0 |
| Sliding Performed | −72.3 | 31.1 | 78.7 |

As is clear from this result, the saturation is increased when the sliding operation is performed. In this case, the dot spread amount was about 21 μm.

As described above, in the fixing device according to the present embodiment, at least one of the first rotating member and the second rotating member is caused to continuously slide in a predetermined direction that differs from the rotation direction while a single recording material is being subjected to the fixing process in the fixing nip portion. Accordingly, a shear force is continuously applied to the toner image in a constant direction that is perpendicular to the toner stacking direction while a single recording material is being subjected to the fixing process in the fixing nip portion.

Although the fixing and pressing members are both rollers in the above-described structure, the fixing and pressing members are not limited to rollers as long as the above-described effects can be achieved. In addition, although the halogen heaters are used as the heat sources in the fixing device, the fixing device may instead include electromagnetic induction heaters or ceramic heaters.

Fixing Device According to Second Embodiment

Figure 10:
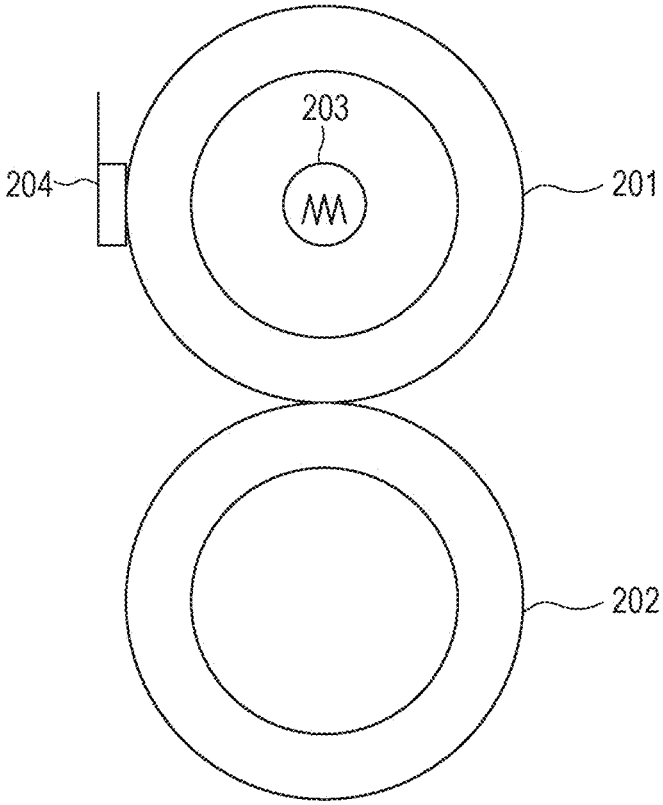
FIG. 10 is a schematic sectional view of a fixing device according to a second embodiment.

A fixing device 9 includes a fixing roller (first rotating member) 201 and a pressing roller (second rotating member) 202 that serve as a pair of upper and lower rotating bodies that are in pressure contact with each other, as illustrated in FIG. 10. The fixing roller 201 and the pressing roller 202 rotate while nipping the recording material therebetween and transferring the recording material, and heat the toner image on the recording material. As described below, in the fixing device 9, the generatrix of the fixing roller and the generatrix of the pressing roller are skew and not parallel to each other.

The fixing roller 201 has a three-layer structure including a pipe-shaped core bar made of iron, aluminum, etc., as a base layer, a heat-resistant silicone rubber layer provided on the core bar as an elastic layer, and a fluorocarbon resin layer made of a material with high releasability and provided on the elastic layer as a surface layer. The surface layer has a function of preventing the toner from offsetting onto the fixing roller in the fixing process. Therefore, the surface layer is preferably formed of a fluorocarbon resin layer made of, for example, tetrafluoroethylene hexafluoropropylene copolymer (FEP), tetrafluoroethylene-perfluoroalkylvinyl ether copolymer (PFA), or polytetrafluoroethylene (PTFE).

The thickness of the elastic layer is preferably in the range of 1 mm or more and 5 mm or less. If the thickness of the elastic layer is less than 1 mm, the fixing roller 201 has a high hardness and it is difficult to form a nip portion with a sufficient width by deforming the heat-resistant silicone rubber. If the thickness of the elastic layer is more than 5 mm, the temperature difference between the base layer and the surface layer is large since the heat source is disposed in the core bar, which is the base layer. As a result, the heat-resistant silicone rubber easily deteriorates. Therefore, the thickness of the elastic layer is preferable about 1 mm to 5 mm.

In the fixing roller 201 according to the present embodiment, the cylindrical core bar is made of aluminum and has a diameter of 60 mm, a thickness of 3 mm, and an inner diameter of 54 mm. The elastic layer, which is provided around the outer periphery of the core bar, is made of a silicone rubber and has a JIS-A hardness of 20° and a thickness of 2.5 mm. The surface layer, which covers the outer periphery of the elastic layer, is formed of a tube which is made of PFA and has a thickness of 50 μm. The tube that forms the surface layer may instead be made of PFA or PTFE. The fixing roller 201 is formed by injecting liquid silicone rubber having a JIS-A hardness of 10° for forming the elastic layer into the space between the tube-shaped surface layer made of PFA and the core bar inserted through the surface layer, and then performing a burning process.

Similar to the fixing roller, the pressing roller 202 has a three-layer structure including a pipe-shaped core bar made of iron, aluminum, etc., a heat-resistant silicone rubber layer provided on the core bar as an elastic layer, and a fluorocarbon resin layer made of a material with high releasability and provided on the elastic layer as a surface layer. The pressing roller 202 is formed by forming a 2-mm thick elastic layer made of a silicone rubber around the core bar and forming a release layer made of fluorocarbon resin around the outer periphery of the elastic layer as the surface layer. A nip portion is formed between the pressing roller 202 and the fixing roller 201 that is rotated by a drive mechanism (not shown), and the pressing roller 202 is rotated by the rotation of the fixing roller 201.

The elastic layer formed on the core bar of the pressing roller 202 is made of a low temperature vulcanization (LTV) or high temperature vulcanization (HTV) silicone rubber so that the nip portion can be formed between the fixing roller 201 and the pressing roller 202. If the elasticity of the elastic layer is low, there is a risk that portions in the toner image in recesses cannot be fixed or the image resolution will be reduced due to crushing of the toner. Therefore, it is necessary that the elastic layer have an appropriate elasticity.

To set the required width of the fixing nip portion (dimension in the conveying direction of the recording material) to 10 mm in the above-described structure, the pressing force (compressing force) applied to the fixing roller 201 by the pressing roller 202 is set to 800 N.

The core bar of the fixing roller 201 has a cylindrical shape with a hollow space therein, and a halogen heater 203 is disposed in the hollow space as a heating portion. The heat required for the fixing process is supplied to the fixing roller 201 by the halogen heater 203. The fixing roller 201 is in contact with a thermister (temperature detection element) 204 that measures the temperature of the fixing roller 201. The temperature of the fixing roller 201 is controlled as follows. That is, the temperature of the fixing roller 201 is detected on the basis of a change in the resistance of the thermister 204 caused by a temperature change, and the ON/OFF state of the halogen heater 203 is controlled by a control device (not shown) so as to maintain the temperature of the fixing roller 201 to a certain temperature.

Figure 11:
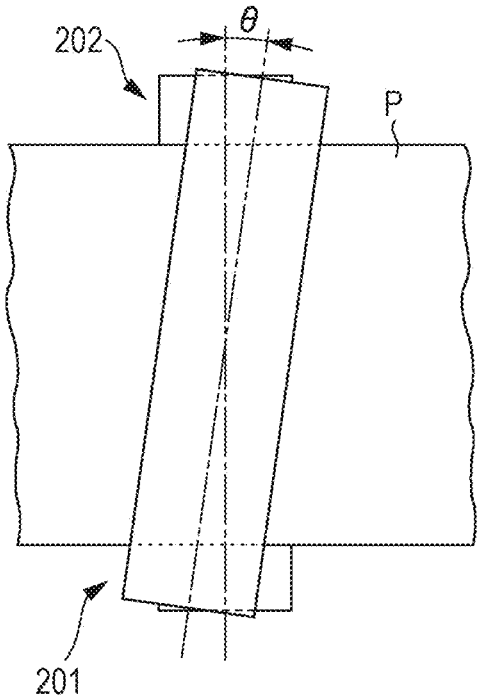
FIG. 11 is a top view of the fixing device according to the second embodiment.
Figure 12:
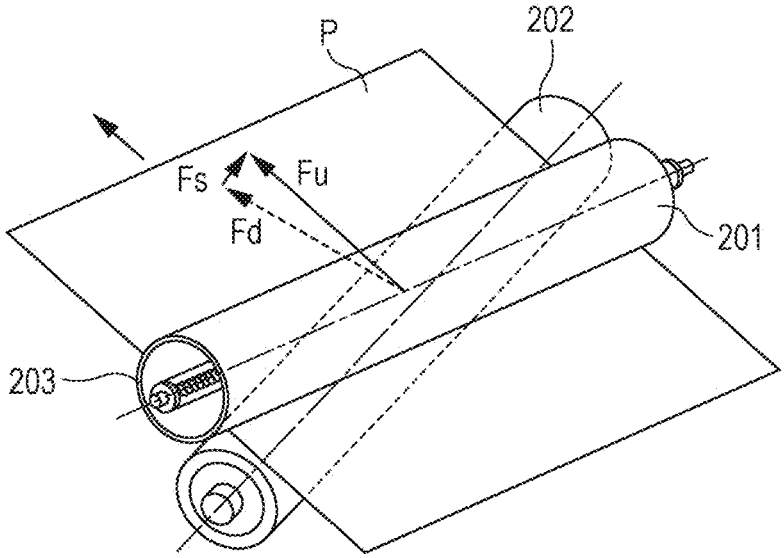
FIG. 12 is a perspective view of the fixing device according to the second embodiment.

FIGS. 11 and 12 are a top view and a perspective view, respectively, of the fixing device according to the present embodiment. The fixing roller 201 and the pressing roller 202 are arranged such that the axes of the core bars thereof are skew and not parallel to each other (the second rotating member has a crossing angle with respect to the first rotating member). FIG. 11 is a projection of the fixing roller and the pressing roller viewed from the top. The axes of the core bars of the fixing roller 201 and the pressing roller 202 are skew at a crossing angle θ. In the perspective view of FIG. 12, the crossing angle θ is increased for explanation. In this figure, Fu shows a force applied to the top surface of the recording material in a direction perpendicular to the axis of the fixing roller. Similarly, Fd shows a force applied to the bottom surface of the recording material in a direction perpendicular to the axis of the pressing roller. Fs is a differential vector between Fd and Fu, and shows a direction in which a shear force is applied in the nip portion. The toners in the nip portion are heated and fixed while receiving the shear force in the direction shown by Fs, and easily spread in the in-plane direction of the recording material owing to the shear force. The recording material passes through the nip portion in a direction perpendicular to the axis of one of the fixing roller 201 and the pressing roller 202. Accordingly, the shear force is continuously applied to the recording material in a predetermined direction along the longitudinal direction of one of the rollers while the recording material passes through the fixing nip portion.

When the crossing angle θ increases, the shear force generated in the nip portion increases accordingly. Therefore, the force applied to the toners in the in-plane direction increases, and the effect of spreading the toners in the in-plane direction increases accordingly. However, when the shear force along the plane of the recording material increases, the stress applied to the surfaces of the fixing roller and the pressing roller increases. Therefore, there is a problem of durability of the surface layers.

In general, when the fixing roller and the pressing roller including thin-walled core bars are pressed against each other, the axial centers of the rollers are affected by deflections of the rollers and the nip portion has an inverted-crown shape in which the width of the nip portion is large at both ends thereof. However, when the crossing angle is provided, the width of the nip portion is geometrically reduced at both ends of the nip portion. Therefore, the crossing angle θ is preferably set so that the nip width at both ends of the nip portion is substantially equal to or larger than that at the center of the nip portion. When the crossing angle θ is set to an angle larger than or equal to the angle that corresponds to the deflections of the fixing roller and the pressing roller, the nip width at both ends of the nip portion will be smaller than that at the center of the nip portion. In such a case, there is a risk that the recording material will be wrinkled. Therefore, the crossing angle θ is preferably in the range of about 0.15° to 3°. In the present embodiment, the crossing angle θ is set to about 1.0°. In this case, the nip width at the center of the nip portion is 10 mm and that at both ends of the nip portion is 10.5 mm.

Figure 13:
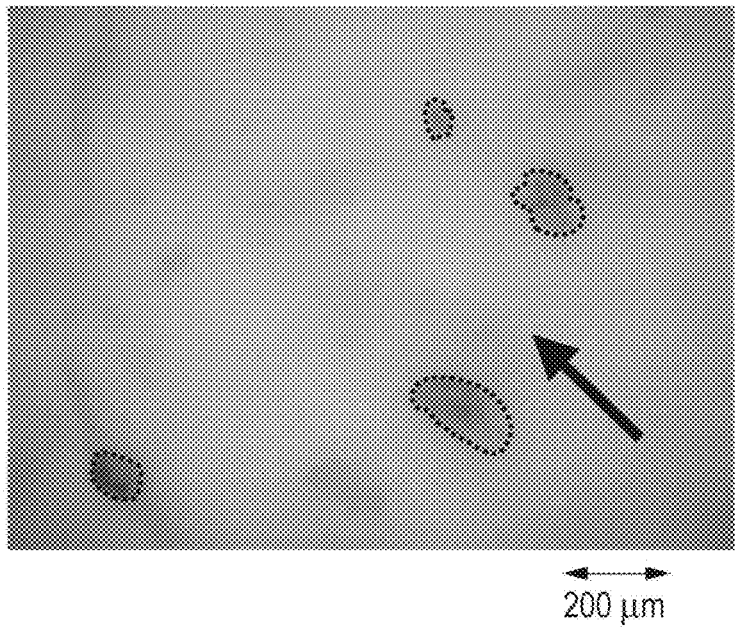
FIG. 13 illustrates the result of microscopic observation of a fixed image formed when a crossing angle is provided.
Figure 14:
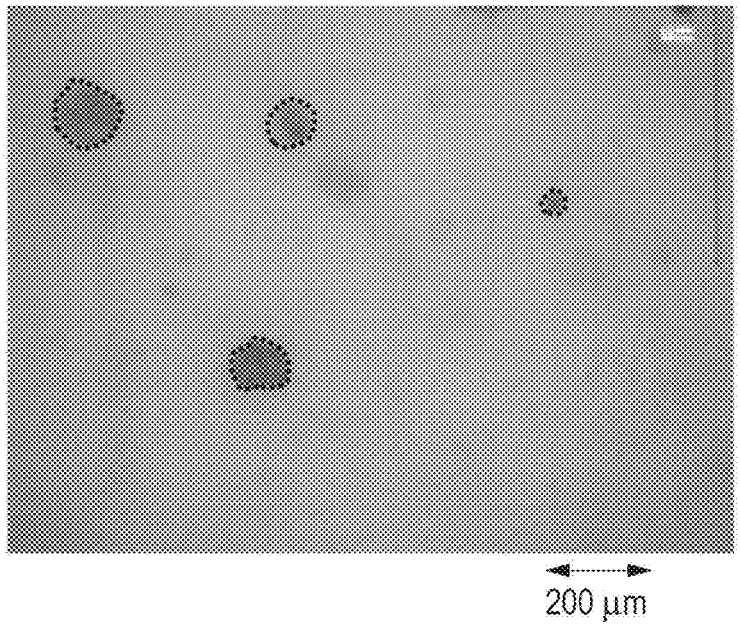
FIG. 14 illustrates the result of microscopic observation of a fixed image formed when the crossing angle is 0°.

FIG. 13 illustrates the result of microscopic observation of a state in which toners is fixed to a sheet of coated paper according to the present embodiment. Each of the black areas (areas surrounded by dotted lines) shows a single toner dot image in the state after the fixing process. Owing to the combined force of the shear force generated in a direction parallel to the plane of the recording material and the force in the conveying direction in the fixing nip portion, the dot images spread in an inclined direction (direction shown by the arrow). For comparison, FIG. 14 shows a fixed image formed by an ordinary heat roller fixing process in which the same rollers as those in the present embodiment are used and the crossing angle θ is set to zero. In FIG. 14, the shear force in the in-plane direction of the recording material is not applied and only the pressing force in the direction perpendicular to the recording material is applied. Therefore, substantially circular toner images are formed.

Figure 15:
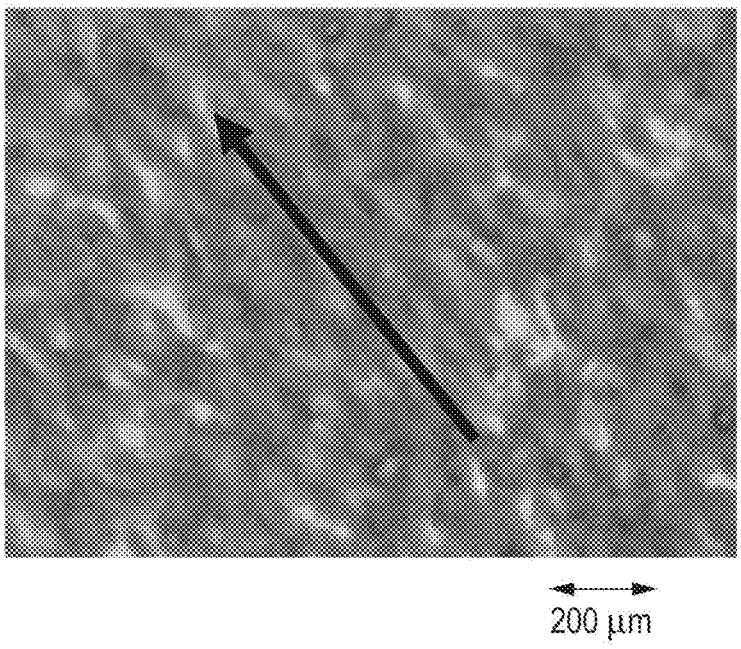
FIG. 15 illustrates the result of microscopic observation of a fixed image (green area) formed when a crossing angle is provided.

FIG. 15 illustrates an enlarged microscopic image of a green area of a fixed image that is subjected to image processing with Photoshop (Adobe Systems Incorporated) so that only the red channel is shown. The fixed image is formed by stacking full-color toners of yellow, magenta, and cyan having a particle diameter of about 6.0 μm on a recording material at an laid-on amount of 0.30 mg/cm$^2$ for each color to form an image and then fixing the image. In this figure, a grayscale image of the red channel is illustrated. The dark areas substantially correspond to the areas in which the density of cyan is high, and the white areas substantially correspond to the areas in which the density of yellow is large. It is also clear from FIG. 15 that the toners spread in the direction shown by the arrow.

Figure 16:
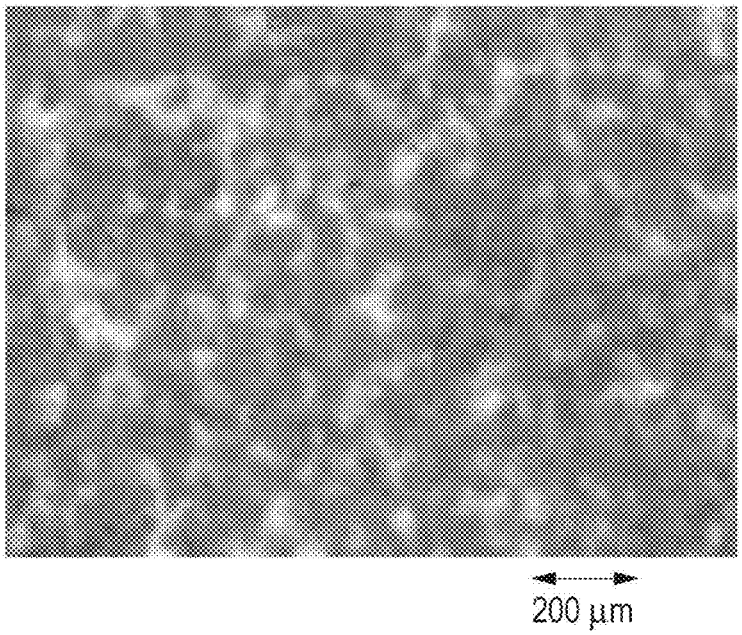
FIG. 16 illustrates the result of microscopic observation of a fixed image (green area) formed when the crossing angle is 0°.

For comparison, FIG. 16 illustrates a green area of a fixed image that is formed by forming an unfixed toner image under the same conditions as above and subjecting the unfixed toner image to an ordinary heat-roller fixing process in which the crossing angle θ is set to zero. In the state illustrated in FIG. 16, the toners do not spread in a direction parallel to the plane of the recording material since only the pressing force in the direction perpendicular to the recording material is applied thereto. Therefore, the toners are arranged in substantially the same manner as that in the unfixed state.

Table 2 shows the values of chromas a* and b* and saturation c* of green patches illustrated in FIGS. 15 and 16. The chromas a* and b* and saturation c* were measured by using a spectral densitometer 530 manufactured by X-Rite, Inc.

TABLE 2

| | a* | b* | c* |
|---|---|---|---|
| Crossing Angle 0° (FIG. 16) | −62.0 | 35.0 | 71.2 |
| Crossing Angle 1° (FIG. 15) | −72.0 | 38.0 | 81.4 |

As is clear from this result, the saturation in the state illustrated in FIG. 15 is higher than that in the state illustrated in FIG. 16. In this case, the dot spread amount was about 20 μm.

As described above, the fixing device according to the present embodiment includes a first rotating member that comes into contact with the unfixed toner image and a second rotating member that has a crossing angle with respect to the first rotating member and that forms the fixing nip portion together with the first rotating member. A shear force in a constant direction that is perpendicular to the toner stacking direction is continuously applied to the toner image while a single recording material is being subjected to the fixing process in the fixing nip portion.

Fixing Device According to Third Embodiment

Figure 17:
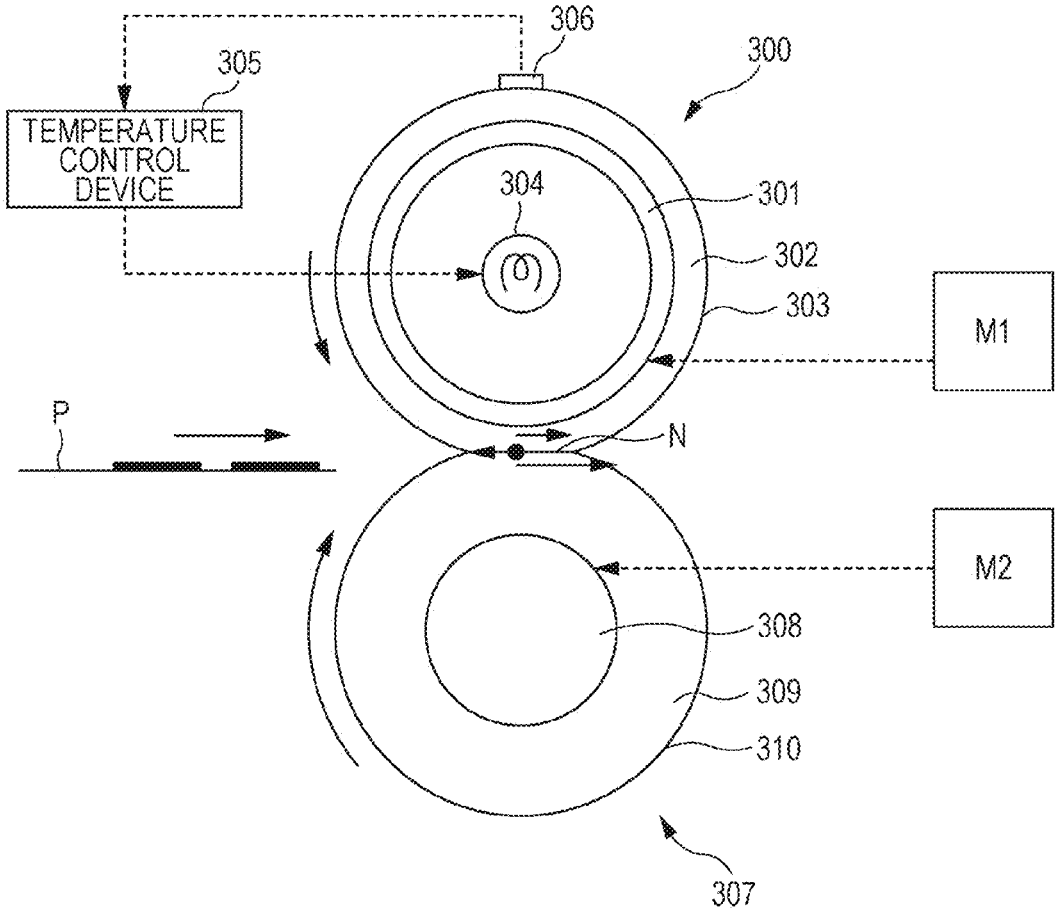
FIG. 17 is a schematic sectional view of a fixing device according to a third embodiment.

FIG. 17 is a schematic sectional view of an example of a fixing device 9. The fixing device 9 includes a heating roller (first rotating member) 300 that is rotatable and has a heat source and a pressing roller (second rotating member) 307 that is rotatable and pressed against the heating roller 300 so as to form a fixing nip portion. A toner image formed on a recording material P is heated and compressed while the recording material P is being nipped and conveyed through the fixing nip portion N. Thus, the toner image is fixed to the recording material P.

The heating roller 300 includes a hollow core bar 301 made of a metal (aluminum, iron, etc.) having a high thermal conductivity, an elastic layer 302 that is made of, for example, a silicone rubber and provided around the core bar 301, and a release layer 303 that is made of, for example, PFA and covers the surface of the elastic layer 302. A halogen heater 304 is disposed in the hollow core bar 301 as a heat source. The operation of the halogen heater 304 is controlled by a temperature control device 305. The temperature control device 305 performs an output control for controlling the operation of the halogen heater 304 on the basis of the surface temperature of the heating roller 300 detected by a thermister 306.

The pressing roller 307 includes a core bar 308 made of a metal (aluminum, iron, etc.), an elastic layer 309 that is made of, for example, a silicone rubber and provided around the core bar 308, and a release layer 310 that is made of, for example, PFA and covers the surface of the elastic layer 309.

The heating roller 300 and the pressing roller 307 are individually driven by drive motors M1 and M2, respectively.

In FIG. 17, the arrows around the fixing nip portion N show the directions of the forces applied in the fixing nip portion N, the forces being the rotating forces of the heating roller 300 and the pressing roller 307 and the force generated by the difference between the rotating forces. In the present embodiment, the rotation speeds of the heating roller 300 and the pressing roller 307 are set to different values (a peripheral speed difference is provided) so that a shear force is applied in the fixing nip portion N. As the difference in rotation speed increases, the shear force increases and the toners more largely spread in the in-plane direction. Therefore, the effect of increasing the color developability also increases. However, when the difference in rotation speed is excessively increased, the toners will excessively spread and characters and line drawings, in particular, will be largely deformed. The effect of the present invention can be achieved by setting the difference in rotation speed within an appropriate range.

Accordingly, as an example of a fixing operation condition according to the present embodiment, the rotation speed of the pressing roller 307 is set to 321 mm/sec, and the rotation speed of the heating roller 300 is set to 315 mm/sec (about 2% lower than the rotation speed of the heating roller). In this case, in a period during which the recording material P passes through the fixing nip portion N having a width of about 10 mm, the heating roller 300 slides along the pressing roller 307 by about 200 μm. In this period, the recording material P also slides along the fixing member while being conveyed. Table 3 shows the values of chromas a* and b* and saturation c* of green patches formed when the peripheral speed difference was set to 0% and 2%. The chromas a* and b* and saturation c* were measured by using a spectral densitometer 530 manufactured by X-Rite, Inc.

TABLE 3

| | a* | b* | c* |
|---|---|---|---|
| Peripheral Speed Difference 0% | −61.3 | 27.2 | 67.1 |
| Peripheral Speed Difference 2% | −65.9 | 26.2 | 70.9 |

As is clear from this result, the saturation can be increased by providing a peripheral speed difference. In this case, the dot spread amount was about 4 μm.

The above-described effect can be obtained even when the direction of the shear force applied to the toners is the same as the conveying direction of the recording material P. However, the effect can be increased when the direction in which the shear force is applied to the toners is opposite to the conveying direction of the recording material P, as illustrated in FIG. 17, since the force that spreads the toners in the in-plane direction can be increased in such a case.

The effect of increasing the color developability differs depending mainly on the laid-on amount, the fixing condition, and the recording material. The effect is particularly large when the laid-on amount is small and the overlapping area of the toners is small. As the fixing condition approaches that under which the toners can be sufficiently melted, for example, as the temperature is increased, the time is increased (speed is reduced), and the toner viscosity is reduced, the toners more largely spread in the in-plane direction of the recording material and the effect can be increased. In addition, as the surface smoothness of the recording material increases, the laid-on between the recording material and the fixing member increases and the force component in the in-plane direction is more efficiently transmitted to the toner. Therefore, the effect can be increased.

The difference in rotation speed necessary to achieve the effect differs depending on the slidability (frictional force) between the recording material P and each of the fixing and pressing members that come into contact with the recording material P. However, the effect of increasing the color developability can be achieved as long as the toner image on the recording material P can be caused to spread in the in-plane direction.

As described above, the fixing device according to the present embodiment includes a first rotating member that comes into contact with the unfixed toner image and a second rotating member that rotates at a peripheral speed that differs from that of the first rotating member and that forms the fixing nip portion together with the first rotating member. A shear force in a constant direction that is perpendicular to the toner stacking direction is continuously applied to the toner image while a single recording material is being subjected to the fixing process in the fixing nip portion.

Surfaces of Fixing Roller and Pressing Roller

In the fixing devices according to the first to third embodiments, the effect of the present invention can be more reliably achieved when the coefficient of friction (maximum coefficient of friction) between the fixing roller and the recording material is lower than the coefficient of friction (maximum coefficient of friction) between the pressing roller and the recording material. Specifically, the surface layer of the fixing roller may be made of pure PFA resin, and the surface layer of the pressing roller may be made of a PFA resin to which a filler, such as carbon or silicon oxide (silica), is added or a latex, which is a mixed elastomer of fluorocarbon rubber and fluorocarbon resin. In this case, the pressing roller has a coefficient of friction that is higher than that of the fixing roller. Alternatively, the pressing roller may be disposed in contact with a roller that applies a small amount of oil to the surface of the pressing roller, and the surface layer of the pressing roller may be made of a rubber, such as a silicone rubber or a fluorocarbon rubber. Also in this case, the pressing roller has a coefficient of friction that is higher than that of the fixing roller. In the present embodiment, the surface layer of the pressing roller is made of a latex manufactured by Daikin Industries, Ltd.

The coefficients of friction between the fixing roller and the image surface of the recording material and between the pressing roller and the back surface of the recording material vary depending on the surface state of the recording material, the toner laid-on amount, and the molten state of the toners. With regard to, for example, the surface state of the recording material, if the recording material is a sheet of coated paper or the like and has good surface characteristics, the coefficients of friction tend to be high. The coefficients of friction also vary in accordance with the amounts of toners on the recording material and the molten state of the toners. For example, a coefficient of friction (maximum coefficient of friction) between a common recording material and pure PFA is about 0.25. In the case where the toners are on the surface of the recording material, the coefficient of friction is about 0.27 when the a halftone image is formed and about 0.2 when a solid image is formed and the toners are sufficiently melted in the nip portion. Thus, the coefficient of friction between the surface of the fixing roller and the recording material varies in the range of about 0.2 to 0.3 depending on the fixing condition.

The coefficient of friction μ is determined from the relationship $F=\mu N$. The recording material is pulled while a constant load N is applied between the recording material and the fixing roller, and the force F required to move the recording material is measured.

The maximum coefficient of friction of the pressing roller having a surface layer made of latex is about 0.3 to 0.4 assuming that, for example, a common recording material is used and the toners are on the back surface of the recording material.

As described above, to effectively achieve the effect of the present invention, the maximum value of the coefficient of friction (maximum coefficient of friction) between the fixing roller and the surface of the recording material is preferably smaller than the minimum value of the coefficient of friction (maximum coefficient of friction) between the pressing roller and the surface of the recording material.

Basically, the difference in coefficient of friction between the pressing roller and the fixing roller is preferably as large as possible. However, if the difference is excessively increased, the coefficient of friction of the pressing roller becomes excessively high. When the coefficient of friction is excessively high, the releasability of the toners tends to be reduced. Therefore, the difference in coefficient of friction between the pressing roller and the fixing roller is preferably 1 or less.

Figure 18:
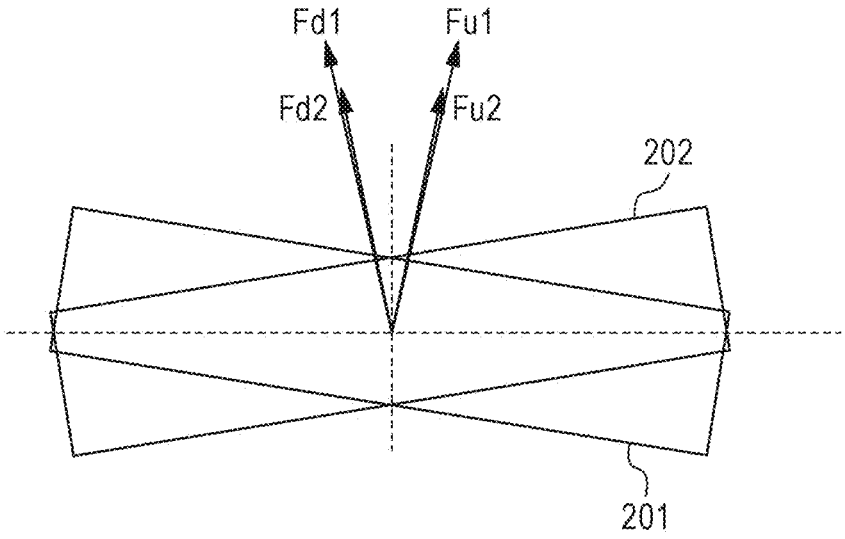
FIG. 18 is a diagram illustrating forces applied to top and bottom surfaces of a recording material in the fixing device according to the second embodiment.

For example, FIG. 18 shows forces applied to the top and bottom surfaces of the recording material in the fixing device having a crossing angle according to the second embodiment. In this figure, Fu shows the force applied to the top surface of the recording material by the fixing roller, and Fd shows the force applied to the bottom surface of the recording material by the pressing roller. Fu1 shows the state in which the frictional force of the fixing roller is at a maximum, and Fu2 shows the state in which the frictional force of the fixing roller is at a minimum. Similarly, Fd1 and Fd2 show the states in which the frictional force of the pressing roller is at a maximum and a minimum, respectively.

The frictional force has a maximum and a minimum since the coefficient of friction varies depending on the surface state of the recording material, the toner laid-on amount, and the molten state of the toners, as described above.

Figure 19A:
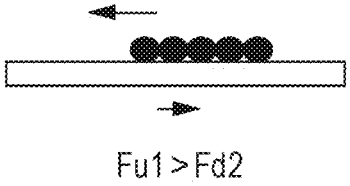
FIGS. 19A and 19B illustrate the relationships between frictional forces applied to top and bottom surfaces of the recording material.

FIG. 19A illustrates the relationship between the forces applied to the top and bottom surfaces of the recording material in the in-plane direction of the recording material in the nip portion when the frictional force Fu between the fixing roller and the top surface of the recording material is larger than the frictional force Fd between the pressing roller and the bottom surface of the recording material. This relationship easily occurs when, for example, the coefficient of friction of the surface of the pressing roller is lower than the coefficient of friction of the surface of the fixing roller or when a halftone image is formed on the top surface of the recording material and a solid image is formed on the bottom surface of the recording material.

In this state, since the frictional force applied to the top surface of the recording material is larger than the frictional force applied to the bottom surface of the recording material, the recording material slips along the surface of the pressing roller and is conveyed in the direction shown by Fu1 in FIG. 18. In addition, in this state, the surface of the fixing roller and the top surface of the recording material grip each other and the bottom surface of the recording material slips. Therefore, the effect of the shear force applied to the toner surface is small.

Figure 19B:
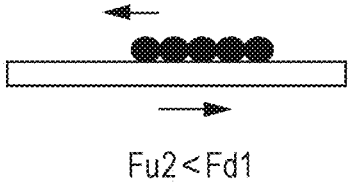

FIG. 19B illustrates the relationship between the forces applied to the top and bottom surfaces of the recording material in the in-plane direction of the recording material in the nip portion when the frictional force Fu between the fixing roller and the top surface of the recording material is lower than the frictional force Fd between the pressing roller and the bottom surface of the recording material. This relationship easily occurs when, for example, the coefficient of friction of the pressing roller is higher than the coefficient of friction of the surface of the fixing roller or when a solid image is formed on the top surface of the recording material and a halftone image is formed on the bottom surface of the recording material.

In this state, since the frictional force applied to the top surface of the recording material is smaller than the frictional force applied to the bottom surface of the recording material, the recording material slips along the surface of the fixing roller and is conveyed in the direction shown by Fd1 in FIG. 18. In addition, in this state, the surface of the pressing roller and the bottom surface of the recording material grip each other and the top surface of the recording material slips. Therefore, the effect of the shear force applied to the toner surface is obtained.

In the present embodiment, since the surface layer of the pressing roller is made of latex, the frictional resistance of the fixing roller is lower than the frictional resistance of the pressing roller and the state of FIG. 19B is constantly established. Therefore, the conveying direction of the recording material is reliably set to the direction shown by Fu1. The effect of the shear force on the surface of the fixing roller is reliably achieved, and the saturation of the secondary color can be reliably increased.

For comparison, a case will be considered in which the surface layer of the fixing roller and the surface layer of the pressing roller are both made of a PFA resin. In this case, the coefficients of friction of the surface of the fixing roller and the surface of the pressing roller are both about 0.2 to 0.3. Since the frictional forces applied to the top and bottom surfaces of the recording material vary depending on the surface state of the recording material, the toner laid-on amount, and the molten state of the toners, the states of FIGS. 19A and 19B cannot be constantly established depending on the above-described conditions. Therefore, the conveying direction of the recording material is random depending on the fixing state, and the direction in which the recording material is ejected through the outlet is be random. As a result, when recording materials that have been subjected to the fixing process are stacked on a tray, aligning and stacking characteristics are degraded. In addition, in duplex printing, the image printing accuracy varies between the front and back surfaces. Furthermore, the effect of the shear force on the surface of the fixing roller cannot be reliably achieved, and there is a possibility that the saturation of the secondary color cannot be increased.

Table 4 shows the result of comparison regarding the stability of the conveying direction of the recording material and the effect of increasing the saturation of the secondary color between the present example in which the coefficient of friction of the fixing roller is smaller than that of the pressing roller and a comparative example in which the fixing roller and the pressing roller have substantially the same coefficient of friction.

TABLE 4

| | Stability of Paper Conveying Direction | Increase in Saturation of Secondary Color |
|---|---|---|
| Example | ○ | ○ |
| Comparative Example | X | Δ |

Recording materials on which unfixed halftone toner images were formed, recording materials on which unfixed solid toner images were formed, recording materials on which unfixed secondary-color solid images were formed, and recording materials on which no image was formed were used. With regard to the stability of the conveying direction of the recording material, according to the present embodiment, the conveying direction of the recording material was substantially constant under any condition, and the variation thereof was within ±0.5 mm. Therefore, the evaluation result was determined as ○ (good). In the comparative example, variation of the conveying direction was large, and was greater than or equal to ±0.5 mm. Therefore, the evaluation result was determined as X (poor). With regard to the effect of increasing the saturation of the secondary color, the saturation c* was about 80 and was increased by about 10 under any condition according to the present embodiment. Therefore, the evaluation result was determined as ○. In the comparative example, the saturation c* was about 75 in some cases and the effect of increasing the saturation varied. Therefore, the evaluation result was determined as Δ (fair).

Relationship Between Toner Particle Arrangement and Color Developability

Unfixed solid images were formed by using four types of toners having different weight average particle diameters and specific gravities and changing the laid-on amount of each color on the recording material in the range of 0.3 mg/cm$^2$ to 0.5 mg/cm$^2$. Each solid image was a secondary color (green) image (laid-on amount 0.6 mg/cm$^2$) including a cyan layer as a lower layer and a yellow layer as an upper layer on the recording material. These images were fixed using a fixing device according to the related art (no shear force is applied) and fixing devices according to the present invention (shear force is applied), and the fixed images were evaluated. The fixing device and the fixing conditions were as follows.

Fixing Device

First Embodiment: Sliding Type

Fixing Condition

1. Sliding operation is not performed and no shear force is applied (fixing according to the related art, normal condition)

Fixing Temperature: 180° C.

Load: 400N

Process Speed: 117 mm/sec

2. Sliding operation is not performed and no shear force is applied (fixing according to the related art, melting promoting condition)

Fixing Temperature: 160° C.

Load: 400N

Process Speed: 39 mm/sec

3. Sliding operation is performed and shear force is applied (fixing device of first embodiment)

Fixing Temperature: 180° C.

Load: 400N

Process Speed: 117 mm/sec

Shear Force Shear force corresponding to dot spread amount of 20 μm

Fixing Condition 1 is a reference. In Fixing Condition 2, the process speed is reduced so as to increase the fixing time and sufficiently promote the melting of the toners. In this case, the fixing temperature is somewhat reduced to prevent the toners from adhering to the surface of the fixing member (hot offset) owing to excessive melting. Fixing Condition 3 is a condition in which the sliding operation according to the first embodiment is added to Fixing Condition 1 so that the shear force is applied.

Evaluated recording materials were coated paper (basis weight 128 g/m$^2$).

Four types of toners listed below were used.

(No. 1) Bizhub PRO C6500 toner manufactured by Konica Minolta Holdings, Inc.

Weight Average Particle Diameter: 6.9 μm

Specific Gravity: 1.13 g/cm$^3$ (No. 2) MX-7001N toner manufactured by Sharp Corporation Weight Average Particle Diameter: 6.4 μm Specific Gravity: 1.24 g/cm$^3$ (No. 3) DocuCentre C6550 toner manufactured by Fuji Xerox Co., Ltd.

Weight Average Particle Diameter: 5.8 μm

Specific Gravity: 1.14 g/cm$^3$ (No. 4) Imagio MP C7500 toner manufactured by Ricoh Company, Ltd.

Weight Average Particle Diameter: 5.1 μm

Specific Gravity: 1.37 g/cm$^3$

The weight average particle diameters of the toners were measured by using a Coulter counter manufactured by Beckman Coulter Inc. The specific gravities of the toners were measured by using Accupyc II manufactured by Shimadzu Corporation.

Table 5 shows the results of evaluation of the color developability of the images formed by forming unfixed toner images on the sheets of coated paper by using the above-listed toners and fixing the unfixed toner images under the above-described fixing conditions.

TABLE 5

| Toner No. | 1 | 1 | 1 | 1 | 1 | 2 | 2 | 2 | 2 | 2 |
|---|---|---|---|---|---|---|---|---|---|---|
| Laid-on Amount A [mg/cm$^2$] | 0.5 | 0.45 | 0.4 | 0.35 | 0.3 | 0.5 | 0.45 | 0.4 | 0.35 | 0.3 |
| Particle Diameter L [μm] | 6.9 | 6.9 | 6.9 | 6.9 | 6.9 | 6.4 | 6.4 | 6.4 | 6.4 | 6.4 |
| Specific Gravity ρ [g/cm$^3$] | 1.13 | 1.13 | 1.13 | 1.13 | 1.13 | 1.24 | 1.24 | 1.24 | 1.24 | 1.24 |
| Laid-on Amount H [μm] | 4.42 | 3.98 | 3.54 | 3.10 | 2.65 | 4.03 | 3.63 | 3.23 | 2.82 | 2.42 |
| Closest-Packed Arrangement Limit [mg/cm$^2$] $\rho\pi L/30\sqrt{3}$ | 0.47 | 0.47 | 0.47 | 0.47 | 0.47 | 0.48 | 0.48 | 0.48 | 0.48 | 0.48 |
| Seeping Limit [mg/cm$^2$] $2\rho\pi L/(5\sqrt{3}(7+3\sqrt{5}))$ | 0.41 | 0.41 | 0.41 | 0.41 | 0.41 | 0.42 | 0.42 | 0.42 | 0.42 | 0.42 |
| Fixing Condition 1 No shear force is applied (fixing of related art) | ○ | X | X | X | X | ○ | X | X | X | X |
| Fixing Condition 2 No shear force is applied (fixing of related art) and melting is promoted | ○ | ○ | X | X | X | ○ | ○ | X | X | X |
| Fixing Condition 3 Shear force is applied (sliding) | ○ | ○ | ○ | ○ | ○ | ○ | ○ | ○ | ○ | ○ |
| **Toner No.** | **3** | **3** | **3** | **3** | **3** | **4** | **4** | **4** | **4** | **4** |
| Laid-on Amount A [mg/cm$^2$] | 0.5 | 0.45 | 0.4 | 0.35 | 0.3 | 0.5 | 0.45 | 0.4 | 0.35 | 0.3 |
| Particle Diameter L [μm] | 5.8 | 5.8 | 5.8 | 5.8 | 5.8 | 5.1 | 5.1 | 5.1 | 5.1 | 5.1 |
| Specific Gravity ρ [g/cm$^3$] | 1.14 | 1.14 | 1.14 | 1.14 | 1.14 | 1.37 | 1.37 | 1.37 | 1.37 | 1.37 |
| Laid-on Amount H [μm] | 4.39 | 3.95 | 3.51 | 3.07 | 2.63 | 3.65 | 3.28 | 2.92 | 2.55 | 2.19 |
| Closest-Packed Arrangement Limit [mg/cm$^2$] $\rho\pi L/30\sqrt{3}$ | 0.40 | 0.40 | 0.40 | 0.40 | 0.40 | 0.42 | 0.42 | 0.42 | 0.42 | 0.42 |
| Seeping Limit [mg/cm$^2$] $2\rho\pi L/(5\sqrt{3}(7+3\sqrt{5}))$ | 0.35 | 0.35 | 0.35 | 0.35 | 0.35 | 0.37 | 0.37 | 0.37 | 0.37 | 0.37 |
| Fixing Condition 1 No shear force is applied (fixing of related art) | ○ | ○ | ○ | X | X | ○ | ○ | X | X | X |

TABLE 5-continued

| | | | | | | | | | | |
|---|---|---|---|---|---|---|---|---|---|---|
| Fixing Condition 2 No shear force is applied (fixing of related art) and melting is promoted | ○ | ○ | ○ | ○ | X | ○ | ○ | ○ | X | X |
| Fixing Condition 3 Shear force is applied (sliding) | ○ | ○ | ○ | ○ | ○ | ○ | ○ | ○ | ○ | ○ |

The toners (No. 1 to No. 4) have different particle diameters L [μm] and specific gravities ρ [g/cm$^3$]. The state of toner particle arrangement on the sheets of coated paper is changed by changing the laid-on amounts A [mg/cm$^2$] of the toners on the sheets of coated paper. The laid-on amount H [μm] is calculated by dividing the laid-on amount A by the specific gravity ρ, and is equivalent to "toner volume per unit area"="height of toner layer". Thus, the amount of toner based on volume is measured in consideration of specific gravity, and the states of toner particle arrangements can be accurately compared. The closest-packed arrangement limit and the seeping limit in Table 5 will be described below.

The fixed images were evaluated by calculating "G area percentage", which is explained below. When the G area percentage is higher than or equal to a criterion, that is, when the overlapping area of the cyan and yellow toners is large and the area that appears green in the image is large, the image is evaluated as ○. When the G area percentage is lower than the criterion, that is, when the overlapping area of the cyan and yellow toners is small and the area that appears green in the image is small, the image is evaluated as X.

Method for Calculating G Area Percentage

A method for calculating the area in which two colors appear to overlap each other in a fixed image formed by staking toners of the two colors, that is, the area that appears green (hereinafter referred to as G area) in this example, will now be described.

First, the fixed image is subjected to transmission image observation by using an optical microscope (STM6-LM measurement microscope manufactured by Olympus Corporation) to obtain a microscope image including areas that appear cyan, yellow, and green. The areas in which the toners of the respective colors do not overlap appear cyan or yellow, and the areas in which the toners overlap appear green. The microscope image is acquired under the following condition.

Eyepiece: Magnification 10×
Objective Lens: Magnification 5×
Field of View: 4.4 mm
Numerical Aperture: 0.13
Light Source Filter: For transmission, MM 6-LBD
Output Light Intensity: MAX The image acquired under the above-described condition is stored by an image filing software FLVFS-FIS (manufactured by Olympus Corporation). The camera proprieties are set as follows.

Shutter Group
Mode: Slow
Shutter Speed: 0.17 [s]
Level Group
Gain: R=2.13, G=1.00, B=1.74
Offset: R/G/B=±0
White Balance: Screen center
Gamma R/G/B=0.67
Sharpness: No
Gain (Camera PGA-AMP)
R/G/B=1.34

Next, the acquired microscope image is trimmed to extract the central portion of the observed region in which the light intensity is stable. The trimming was performed by using Photoshop (Adobe Systems Incorporated), and 2-mm square portion at the center of the image was selected. The trimming is performed to use an area in which the light intensity is stable in the observed region. Therefore, calibration of the light intensity balance in the observed region, for example, may be performed instead of the trimming.

Next, the G area in the observed region is calculated by processing the trimmed image by using an image processing software (Image-Pro Plus manufactured by Planetron, Inc.) with which the image can be binarized into secondary color portions and portions other than the secondary color portions and the areas of the binarized portions can be calculated.

The image obtained by trimming the microscope transmission image is binarized into secondary color portions and portions other than the secondary color portions including single-color and background-color portions, that is, between green areas and areas including single-color areas of cyan and yellow and background-color areas. Here, portions that appear green in the acquired image are extracted by using a threshold and converted into white portions, and portions that appear in colors other than green are converted into black portions. The number of white portions in the binarized image and the area of each white portion are stored in a count file. The areas of the white portions in the acquired binarized image are accumulated by using, for example, Excel (manufactured by Microsoft Corporation), and the area percentage of the white portions is calculated as the G area.

Figure 20A:
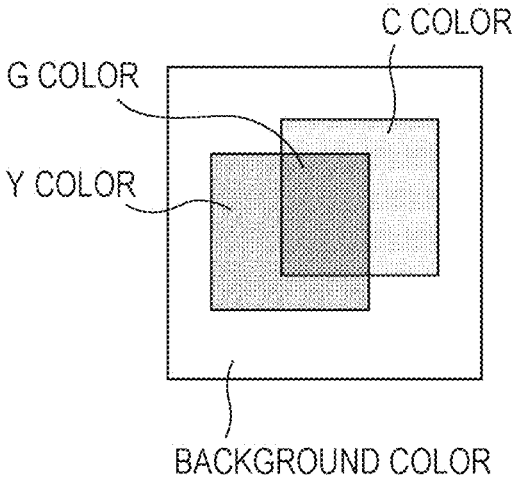
FIGS. 20A and 20B illustrate a method for calculating a G area.
Figure 20B:
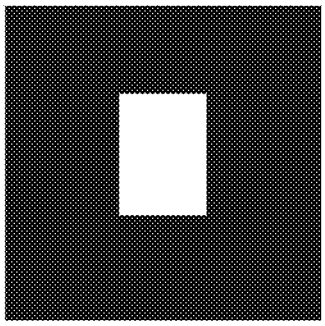

For example, when the image appears as in FIG. 20A is subjected to the above-described binarization process, a binarized image including black and white portions as illustrated in FIG. 20B is obtained. The percentage of the G area is calculated by determining the percentage of the white portion in the binarized image.

Example: $G$ Area Percentage (%) =

$$\{(\text{Area of White Portion})/(\text{Total Area of White and Back Portions})\}\times 100 = \{0.3\times 0.4/1.0\times 1.0\}\times 100 = 12\%$$

Relationship Between G Area Percentage and Saturation

Figure 21:
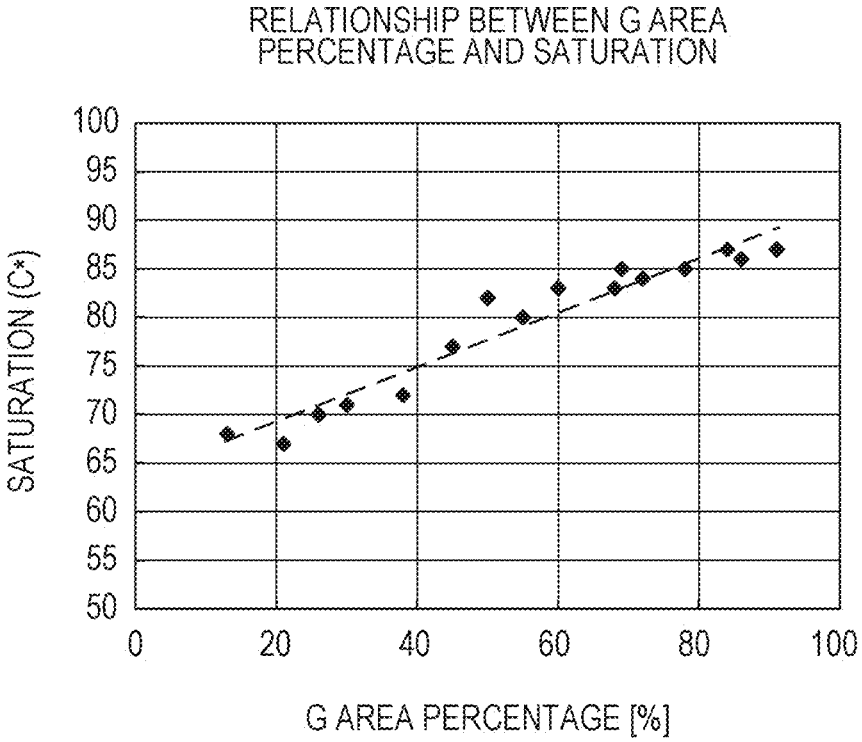
FIG. 21 is a graph showing the relationship between the G area and saturation.

Image samples having different G area percentages were formed by changing the toner laid-on amount and fixing condition, and the saturation c* of green of each image sample was measured. FIG. 21 is a graph showing the relationship between the G area percentage and the saturation c* of green. The saturation c* is expressed as $c^*=(a^{*2}+b^{*2})^{0.5}$ in the color coordinates (L*, a*, b*) of the CIELAB space, which is a color space. The values of color coordinates are measured by Gretag Macbeth Spectro Scan (Gretag Macbeth AG; StatusCode A). As the G area percentage increases, the saturation c* monotonically increases. The image samples were visually checked, and c*=75 or more was set as the evaluation criterion for the saturation at which good color developability can be achieved without defects such as color obscuring or thinning. The G area percentage that corresponds to the criterion was set to 45% from FIG. 21 in consideration of the dispersion. In the image evaluation results described below, the images are evaluated as ○ when the G area percentage is 45% or more, and as X when the G area percentage is less than 45%.

Figure 22:
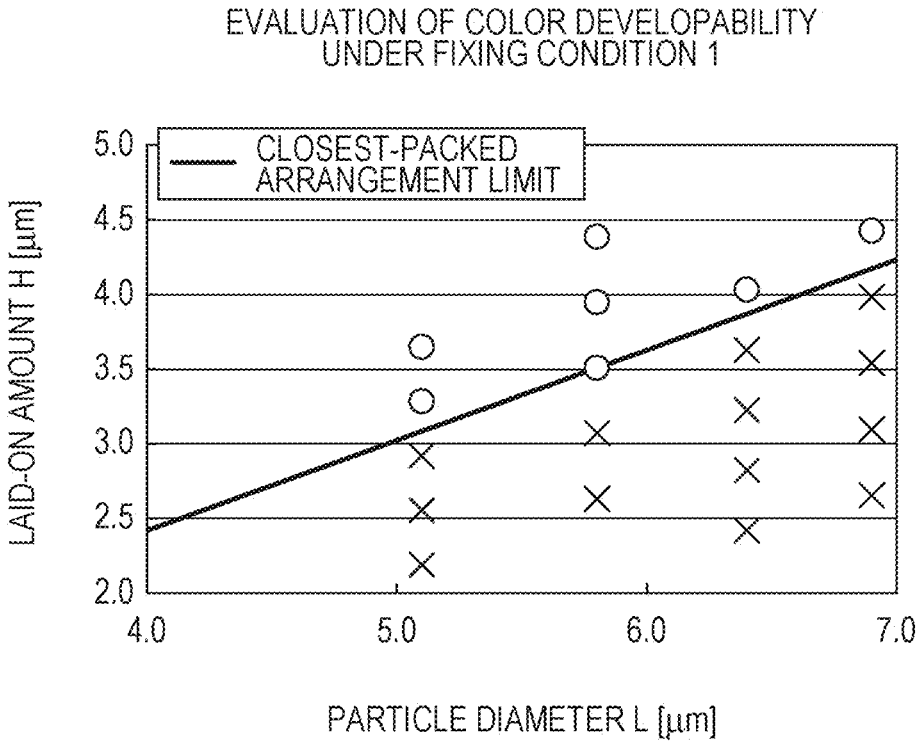
FIG. 22 is a graph showing the results of evaluation of color developability under Fixing Condition 1.
Figure 23:
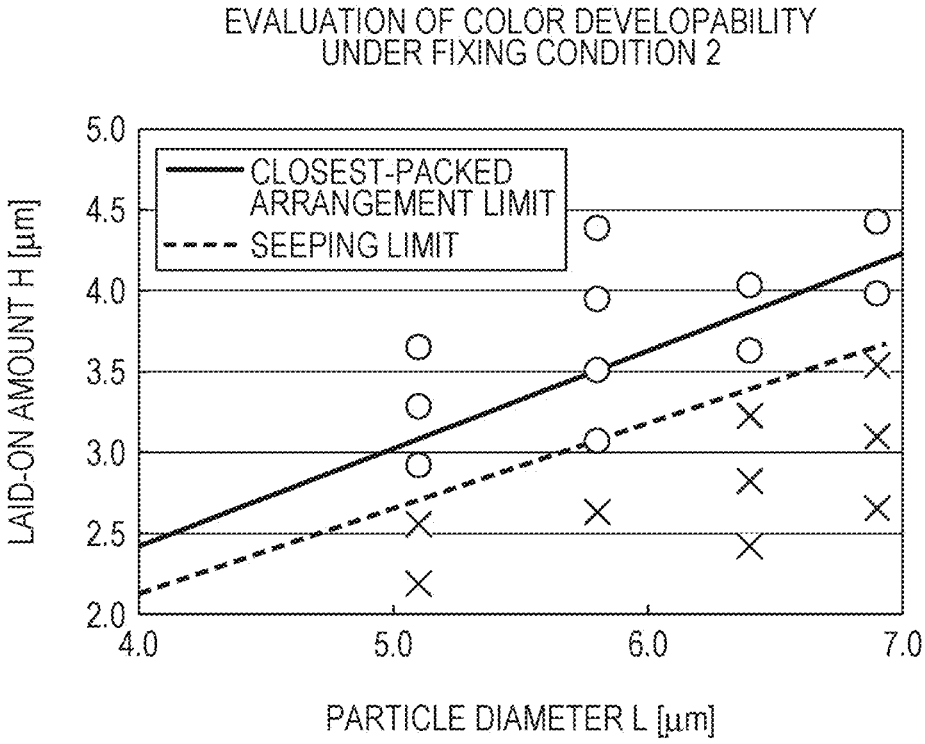
FIG. 23 is a graph showing the results of evaluation of color developability under Fixing Condition 2.
Figure 24:
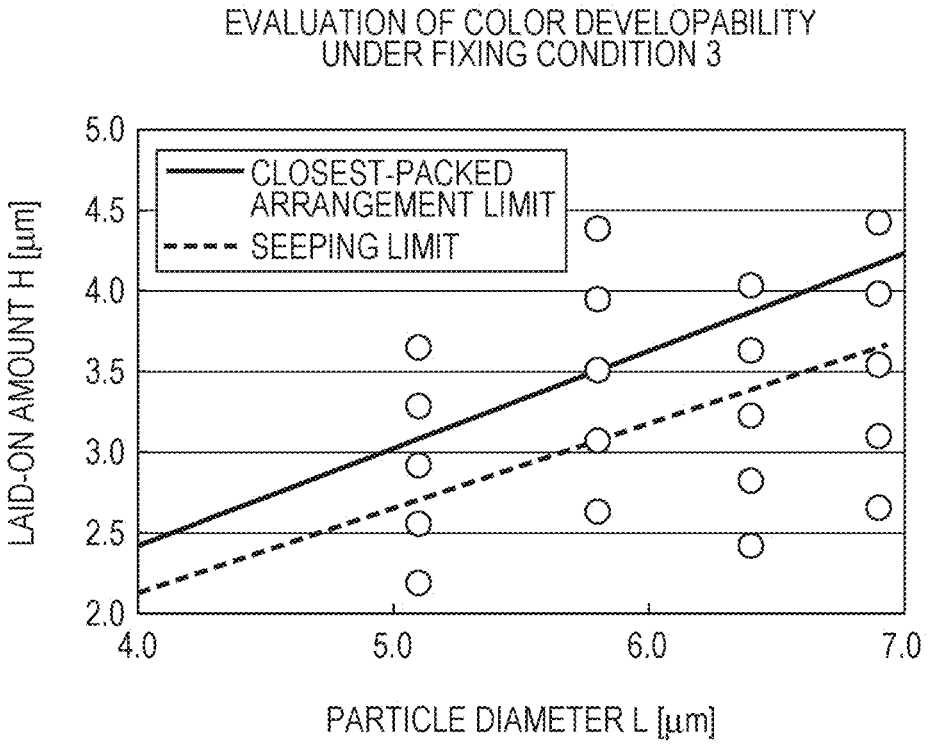
FIG. 24 is a graph showing the results of evaluation of color developability under Fixing Condition 3.

FIGS. 22, 23, and 24 are graphs in which the evaluation results shown in Table 5 are plotted. FIG. 22 is a graph in which the evaluation results of images fixed under Fixing Condition 1 (fixing according to the related art in which no shear force is applied) are plotted. The horizontal axis of the graph represents the particle diameter L [μm], and the vertical axis of the graph represents the laid-on amount H [μm]. In the images evaluated as ○, the toners that form the secondary color sufficiently overlap and good color developability is achieved. In the images evaluated as X, the overlapping state of the toners that form the secondary color is significantly degraded and sufficient color developability is not achieved. It is clear from the graph that an area in which the evaluation results are ○ and an area in which the evaluation results are X are separated from each other. Even when the laid-on amount H is substantially constant, the evaluation result changes from ○ to X when the particle diameter L is increased. Even when the particle diameter L is constant, the evaluation result changes from ○ to X when the laid-on amount H is reduced. To clarify the meaning of the boundary between the areas of the image evaluation results, the state of toner particle arrangement on the recording material was observed and parameters of the toner particle arrangement were calculated.

Figure 25:
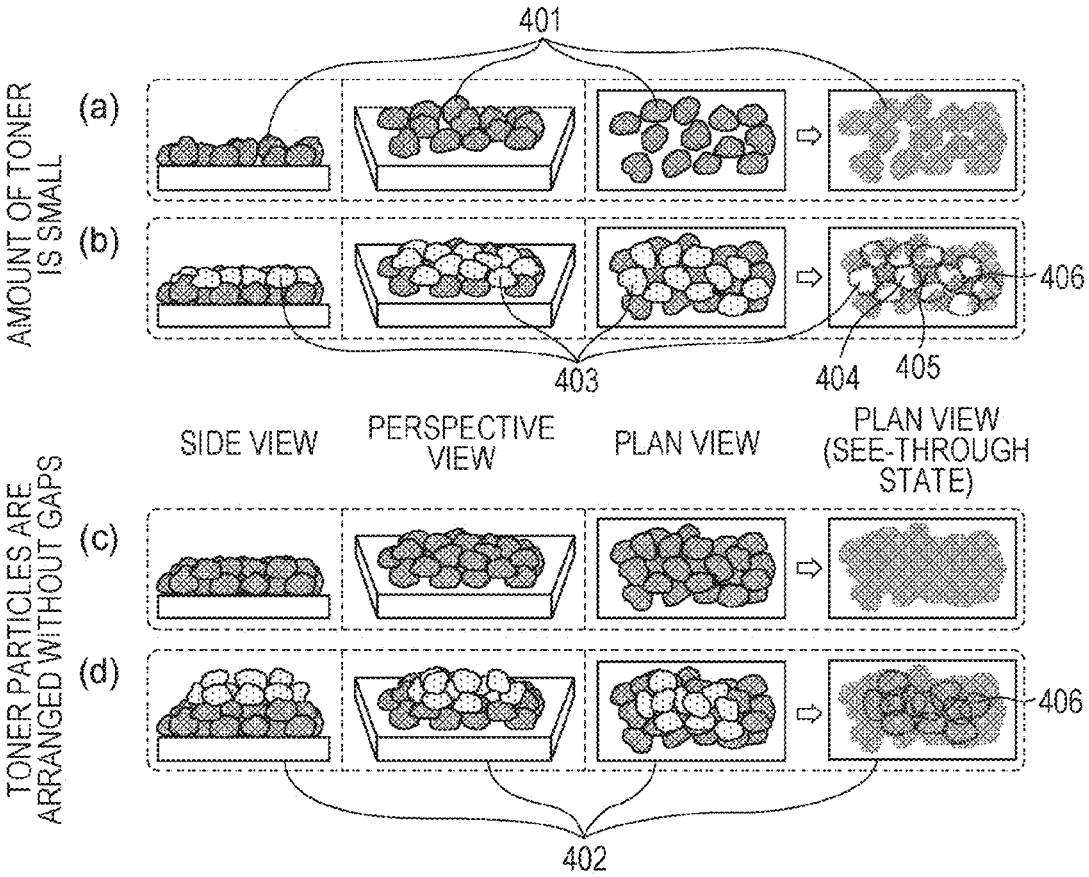
FIG. 25 illustrates the amounts of toners and "states of formation of single-color and secondary-color toner layers".

FIG. 25 illustrates the observation results of the amounts of toners and "states of formation of single-color and secondary-color toner layers". Toner particles 401 for forming a single color layer (cyan in this explanation) and toner particles 403 of a second color (yellow in this explanation) are illustrated. In this figure, parts (a) and (b) respectively show the states of formation of single-color and secondary-color toner layers when the amounts of toners are small, and parts (c) and (d) respectively show the states of formation of single-color and secondary-color toner layers when the amounts of toners are large (when the toner particles are arranged without gaps therebetween).

When the amounts of toners are small, as illustrated in part (a), there are many gaps between cyan toner particles 401 that form a lower layer. In addition, as illustrated in part (b), the yellow toner particles 403, which are toner particles of the second color that form an upper layer, are disposed above the gaps between the cyan toner particles 401. When particles, such as toner particles, are arranged to form layers, the particles that form an upper layer are, of course, disposed between the particles that form a lower layer. Thus, when there are gaps between the cyan toner particles 401 that form the lower layer, the yellow toner particles 403 that form the upper layer are disposed above the gaps. Therefore, a see-through view of the toners illustrated in part (b) (see-through state) includes portions 404 in which only the yellow toner particles 403 in the upper layer exist, portions 405 in which only the cyan toner particles 401 in the lower layer exist, and portions 406 in which the yellow toner particles 403 in the upper layer and the cyan toner particles 401 in the lower layer overlap to generate green color.

When the amounts of toners are large (when the toner particles are arranged without gaps therebetween), as illustrated in part (c), the adjacent cyan toner particles 401 are in contact with each other in the lower layer, and the recording material is almost entirely covered. In addition, as illustrated in part (d), similar to part (b), the yellow toner particles 403, which are toner particles of the second color that form the upper layer, are disposed above the gaps between the cyan toner particles 401. The yellow toner particles 403 stacked on other yellow toner particles 403 are also disposed above the gaps between the yellow toner particles 403. The recording material is reliably covered in the single-color state illustrated in part (c), and the lower layer is also reliably covered by the yellow toner particles 403 that form the upper layer. Therefore, as is clear from the see-through state illustrated in part (d), unlike the see-through state illustrated in part (b) in which the amounts of toners are small, a major part of the area in which the yellow toner particles 403 exist forms the overlapping portions 406 that appear green in which the yellow toner particles 403 in the upper layer and the cyan toner particles 401 in the lower layer overlap.

Thus, when the amounts of toners are large, the overlapping portions 406 in which the secondary color is appropriately formed are formed over a large area. When the amounts of toners are small, as the amounts of toners are reduced, the single-color portions (404 and 405) formed in the gaps in the upper and lower layers increase and the overlapping portions 406 in which the secondary color is appropriately formed decrease. Therefore, when the amounts of toners are reduced from the amounts of toners (laid-on amounts [mg/cm$^2$] or particle diameters [μm]) according to the related art, the color developability of the secondary color is reduced and the recording material cannot be sufficiently covered in single-color forming areas. As a result, the color gamut reproducible range greatly decreases.

Figure 26:
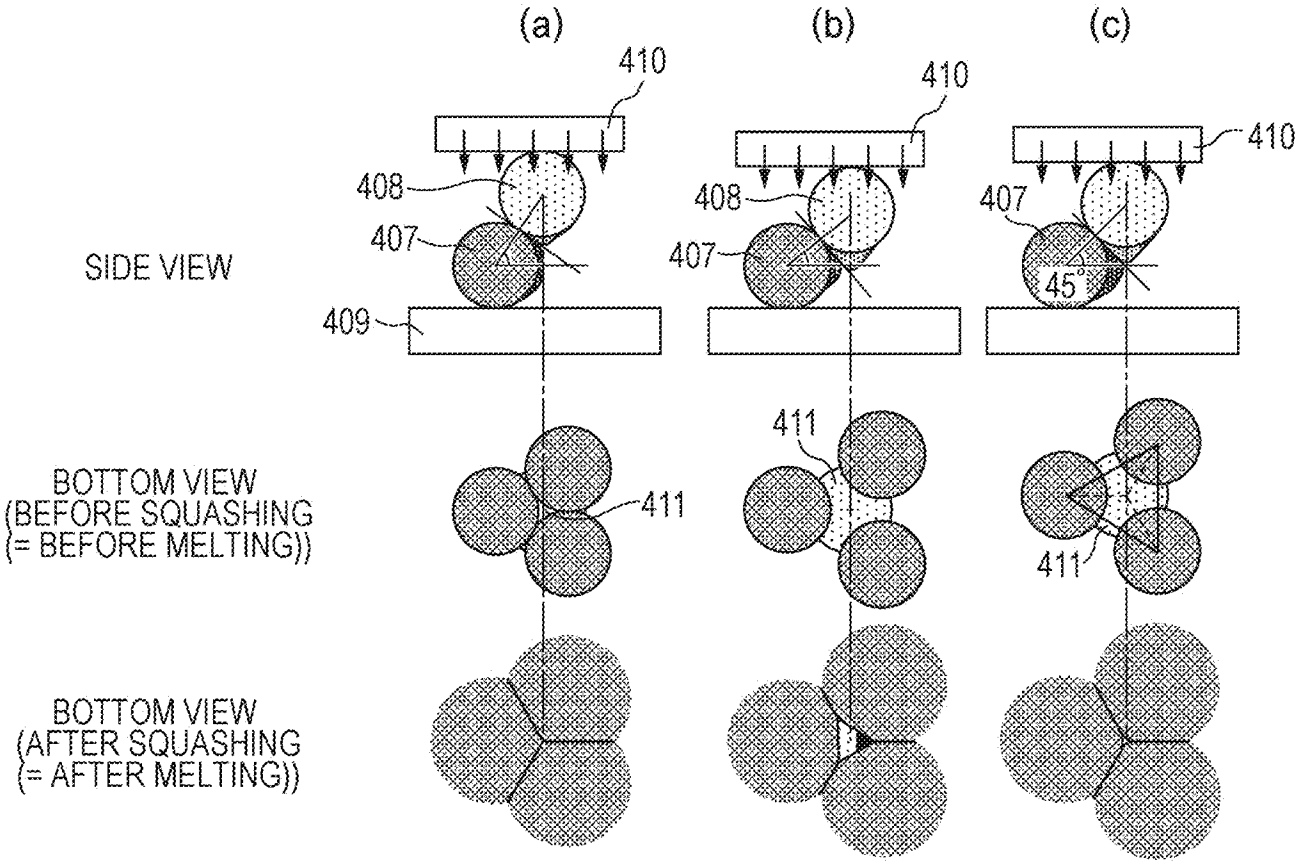
FIG. 26 illustrates the relationship between the toner particle arrangement and seeping phenomenon.
Figure 27A:
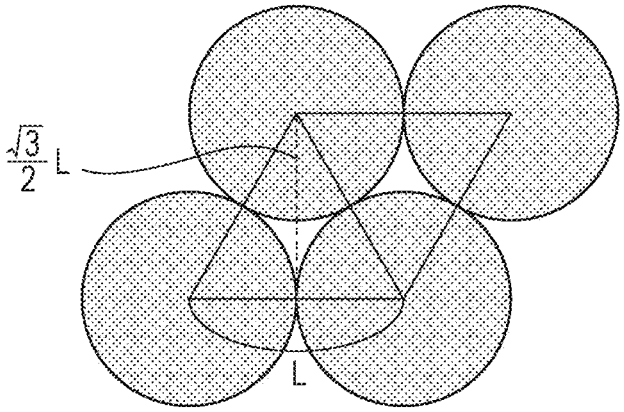
FIG. 27A illustrates a model of a closest-packed arrangement of toner particles and FIG. 27B illustrates a model of a toner particle arrangement in which gaps t are provided between the toner particles.

It has been found from the above-described observation results that the amounts of gaps between the single-color toner particles affect the gamut reproducible range. The gaps between the single-color toner particles increase as the amount of toner decreases. As is clear from the observation results, when there is a sufficient amount of toner particles to form a plurality of layers, the toner particles in an upper layer are arranged so as to fill the gaps between the toner particles in a lower layer. When the amount of toner particles is reduced, it becomes difficult to form a plurality of layers and the gaps between the toner particles gradually increase. When the amount of toner particles is reduced to below the amount required to form a single layer, the gaps significantly increase. To study the boundary condition, assuming that the toner particles are spherical, the amount of toner particles required to form a single layer of spherical toner particles in an ideal closest-packed arrangement (layer having a thickness corresponding to that of a single toner particle) is calculated. The closest-packed arrangement is an arrangement in which the adjacent toner particles of the same color are in contact with each other, as in the arrangement of toner particles 407 in part (a) of FIG. 26 and as illustrated in FIG. 27A. With regard to the parameters used in the calculation, the toner particle diameter is L [μm] and the toner density is ρ [g/cm$^3$].

The volume $V_O$ [μm$^3$] of each toner particle, the projected area $S_O$ [μm$^2$] of the toner particle on a plane, and a unit area (diamond area in FIG. 27A) $S_{\blacksquare}$ [μm$^2$] that includes a single toner particle are as follows.

$$V_{\bigcirc} = \frac{4}{3}\pi\left(\frac{L}{2}\right)^3 \quad S_{\bigcirc} = \pi\left(\frac{L}{2}\right)^2 \quad S_{\blacksquare} = \frac{\sqrt{3}}{2}L^2 \tag{1}$$

The toner laid-on amount H [μm] (toner volume per unit area=average toner height) of a single layer (single color) of toner particles in the closest-packed arrangement (arrangement in FIG. 27A) is calculated as follows.

$$H\frac{V_{\bigcirc}}{S_{\blacksquare}} = \frac{4}{3}\pi\left(\frac{L}{2}\right)^3 \cdot \frac{2}{\sqrt{3}\,L^2} = \frac{\pi L}{3\sqrt{3}} \tag{2}$$

The toner laid-on amount A [mg/cm$^2$] (weight per unit area) is calculated as follows.

$$A = \frac{1}{10}\rho H = \frac{\rho\pi L}{30\sqrt{3}} \tag{3}$$

(in the equation, "1/10" is introduced to match the units)

In FIG. 22, the solid line shows the relationship between the particle diameter L and the laid-on amount H obtained from the above equation. It is clear from the graph that the solid line is on the border between the area in which the image evaluation results are ○ and the area in which the evaluation results are X. Thus, in the evaluation results of the images fixed under Fixing Condition 1 (fixing according to the related art in which no shear force is applied) shown in FIG. 22, the evaluation results are ○ when the amounts of toners are larger than the closest-packed arrangement limit and are X when the amounts of toners are smaller than the closest-packed arrangement limit.

FIG. 23 is a graph in which the evaluation results of the images fixed under Fixing Condition 2 (fixing according to the related art in which no shear force is applied and melting is promoted) are plotted. In Fixing Condition 2, the process speed is reduced to ⅓ of that in Fixing Condition 1, so that the fixing time is increased by a factor of 3 and melting of the toners is sufficiently promoted. The evaluation results in an area which is near the closest-packed arrangement limit and in which the evaluation results are X in Fixing Condition 1 are changed to ○. This is because since the melting of the toners is extremely promoted, the toners spread to the limit thereof and the overlapping area of the secondary color is increased. However, when the laid-on amount is small or the particle diameter is large, the evaluation results are X and sufficient color developability cannot be obtained. Although the fixing time is increased to promote melting in this example, from the viewpoint of increasing the overlapping area of the secondary color, a similar effect can be achieved by increasing the load or temperature.

It is clear from the above-described results that, even when the toners are sufficiently melted, areas in which sufficient color developability cannot be obtained are formed under the conditions according to the related art in which no shear force is applied. It can be assumed that the boundary is below the closest-packed arrangement limit.

The meaning of the boundary of the image evaluation results (which is expected to be below the closest-packed arrangement limit) will now be discussed. As described above, when the arrangement of toner particles on the recording material is observed, toner particles that form an upper layer are disposed between the particles that form a lower layer. To simulate the process in which the toner particles in this arrangement are melted and deformed, an experiment was performed by using clay balls. The experiment will be explained with reference to FIG. 26.

Clay balls 407 and 408 of different colors were formed as models of lower-layer toner particles and upper-layer toner particles, respectively. The clay balls 407 (lower-layer toner particles) were placed on a flat plate 409 and arranged in the closest-packed arrangement (a) in which the clay balls 407 are in contact with each other and arrangements (b) and (c) in which the clay balls 407 are arranged with constant gaps therebetween. It is assumed that the amount of toner is large in the order of (a), (c), and (b). The clay balls 408 (upper-layer toner particles) were arranged such that a single clay ball 408 is at the center of three clay balls 407 (lower-layer toner particles). Assuming that a flat plate 410 is the fixing member, the flat plate 410 was moved downward from above so as to squash the clay balls in each of the arrangements, thereby simulating the manner in which the toner particles are deformed when they are melted. The states of the clay balls before and after the deformation were observed. Side views of the arrangements of the clay balls are illustrated in the upper area of FIG. 26. The clay balls have a spherical shape before they are squashed, and portions of the clay balls that are deformed and spread when the clay balls are squashed are shown as dark areas (only two clay balls are shown to simplify the drawing). Bottom views (views from the flat-plate-409 side) of the clay balls before the squashing process are illustrated in the middle area of FIG. 26, and bottom views of the clay balls after the squashing process are illustrated in the lower area of FIG. 26.

In the closest-packed arrangement (a), a gap 411 formed between the clay balls 407 (lower-layer toner particles) before the squashing (melting) process was completely filled with the clay balls 407 (lower-layer toner particles) after the squashing (melting) process, and a single layer was formed (see the bottom view). This is because the clay balls 407 (lower-layer toner particles) had spread in the horizontal direction and joined together before the clay ball 408 (upper-layer toner particle) spread downward. In this state, the area in which the upper-layer and lower-layer toner particles overlap is large and a satisfactory secondary color can be obtained. In the arrangement (b), a large gap 411 was formed between the clay balls 407 (lower-layer toner particles) before the squashing (melting) process. The gap between the clay balls 407 (lower-layer toner particles) was not filled even after the squashing (melting) process. It can be understood from the figure that the clay ball 408 (upper-layer toner particle) seeped into the gap 411. This is because the clay ball 408 (upper-layer toner particle) had spread downward and entered the gap 411 before the clay balls 407 (lower-layer toner particles) spread in the horizontal direction to join together. In this state, the area in which the upper-layer and lower-layer toner particles overlap is small and the color developability of the secondary color is reduced.

In the arrangement (c), a gap 411 formed between the clay balls 407 (lower-layer toner particles) before the squashing (melting) process was filled after the squashing (melting) process, and seeping of the clay ball 408 (upper-layer toner particle) did not occur. This is because the spreading of the clay balls 407 (lower-layer toner particles) and the spreading of the clay ball 408 (upper-layer toner particle) occurred at substantially the same time. In this case, referring to the side view, the line that connects the centers of the clay ball 407 (lower-layer toner particle) and the clay ball 408 (upper-layer toner particle) is at 45° relative to the horizontal plane.

From the above-described results, it can be assumed that even the amount of toner is below the closest-packed arrangement limit, that is, even when the toner particles are arranged with gaps therebetween in each single-color toner layer, there is a limit condition (hereinafter referred to as a seeping limit) under which melting occurs without causing seeping of the toner particles and sufficient overlapping area of the secondary color can be ensured so that satisfactory color developability can be obtained. From the result of the arrangement (c), it is expected that the seeping limit of the toner particles corresponds to the arrangement in which the line connecting the centers of the upper-layer and lower-layer toner particles is at 45° relative to the horizontal plane. Accordingly, the amount of toner required to form a single layer of spherical toner particles in the arrangement corresponding to the seeping limit was calculated.

First, the gaps formed between the toner particles will be described in detail. Assuming the state in which there are gaps between the adjacent toner particles, even when the amount of toner per unit area is constant, the toner particles may either be arranged such that the gaps therebetween are constant or such that large and small gaps are formed in a mixed state. In the actual toner layers, the gaps are not constant, and large and small gaps are formed in a mixed state. Compared to the case in which the gaps are constant, when large and small gaps are formed in a mixed state, the upper-layer toner particles (toner particles of a color different from that of the lower-layer toner particles) more easily fall into the gaps between the lower-layer toner particles. In other words, the seeping more easily occurs. Accordingly, a unit of three toner particles that are gathered together, which is the minimum unit for geometrically discussing the arrangement of the toner particles, will be considered.

Figure 28:
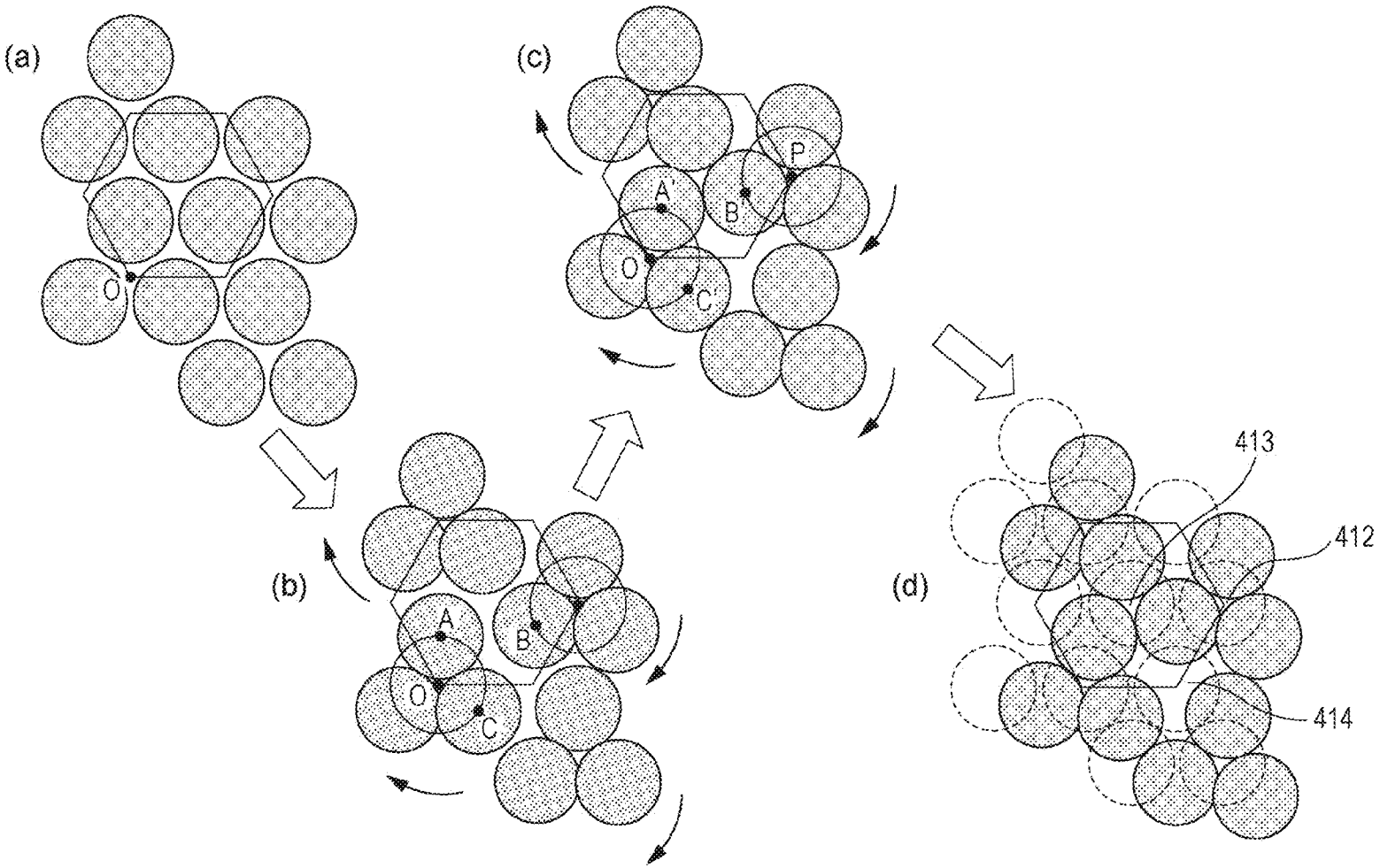
FIG. 28 is a diagram that illustrates a seeping limit.

Parts (a), (b), and (c) of FIG. 28 show the arrangements having the same amount of toner per unit area (the same toner laid-on amount). Part (a) of FIG. 28 illustrates the state in which the toner particles are arranged with constant gaps t [μm] (distance of closest approach) between the adjacent toner particles. In this state, the gaps are small and the upper-layer toner particles do not easily fall into the gaps between the lower-layer toner particles.

Part (b) of FIG. 28 illustrates the state in which the arrangement of toner particles in Part (a) of FIG. 28 is changed such that every three toner particles are gathered together. In Part (b) of FIG. 28, four toner particle groups, each of which includes three toner particles that are gathered together, are formed.

Part (c) of FIG. 28 illustrates the state in which the toner particle groups illustrated in Part (b) of FIG. 28 are rotated by the same angle θ around the centers thereof so that the toner particle groups come into contact with one another (toner particles A' and B' are in contact with each other). The arrangement illustrated in Part (c) of FIG. 28 has the same toner laid-on amount as that of the arrangement illustrated in Part (a) of FIG. 28. Although the toner laid-on amount is constant, the toner particles arranged in this manner have the largest gaps therebetween.

Part (d) of FIG. 28 illustrates the state in which the upper-layer toner particles (shown by transparent circles) are placed on the lower-layer toner particles illustrated in Part (c) of FIG. 28 (the state in which a toner image of the first color is transferred). As is clear from this figure, a single upper-layer toner particle is fitted into a small gap 412 (413) at the center of each toner particle group in which three lower-layer toner particles are gathered together, and a single upper-layer toner particle is fitted into a large gap 414 formed between the toner particle groups in the lower layer. The upper-layer toner particle fitted in the large gap 414 is positioned lower than the upper-layer toner particle fitted in the small gap 412 (413).

When the arrangement of Part (c) of FIG. 28 is considered as the possible arrangement in the toner layer of the first color, a non-uniform state in which seeping is most likely to occur when the toner laid-on amount is constant can be considered. In this non-uniform state, the limit point at which seeping occurs corresponds to the state in which the line connecting the center of the single upper-layer toner particle that is disposed above the large gap 414 and the center of one of the lower-layer toner particles that form the large gap 414 is at 45° relative to the horizontal plane.

Figure 29A:
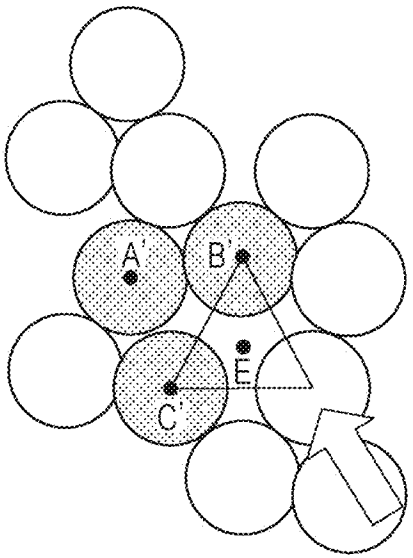
FIGS. 29A to 29C are diagrams that illustrate the seeping limit.
Figure 29B:
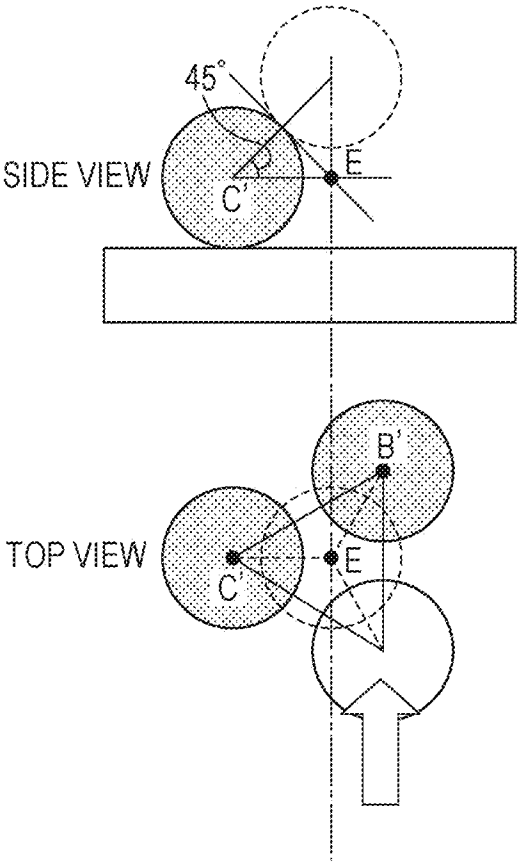
Figure 29C:
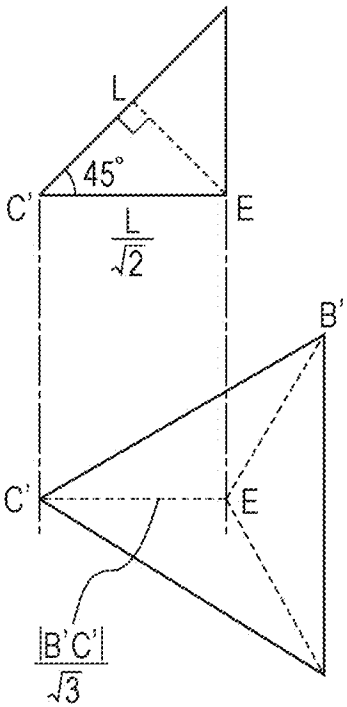

To calculate the arrangement of the toner particles A', B', and C' in the non-uniform state illustrated in FIG. 28, a necessary part is extracted and shown in FIGS. 29A, 29B, and 29C. FIG. 29A shows the arrangement of toner particles A', B', and C' by which the non-uniform state is characterized. FIG. 29B shows a side view and a top view. FIG. 29C is a geometric diagram used to calculate the distances between the points.

Referring to FIGS. 29A, 29B, and 29C, the center-to-center distance between the toner particles A' and B' is equal to the average particle diameter L [μm] of the toner particles. The relationship between the center-to-center distance between the toner particles B' and C' and the distance between the center E of the gap 414 and the center of the toner particle C' is as follows.

$$|A'B'| = L, \left|\frac{B'C'}{\sqrt{3}}\right| = \frac{L}{\sqrt{2}}$$

When the point O in Parts (a), (b), and (c) of FIG. 28 is defined as the origin, the coordinates of points P, A, A', B, B', C, and C' can be calculated. FIG. 30 shows the coordinates of each point. The coordinates are calculated as those obtained by rotating the toner particle groups, each of which includes three lower-layer toner particles that are gathered together, around the centers O and P of the small gaps at the centers of the toner particle groups by the angle θ, as illustrated in Parts (b) and (c) of FIG. 28. When these coordinates are substituted into the above equations, the following equations are obtained.

$$|A'B'|^2 = \left(\frac{3}{2}R - \frac{L}{\sqrt{3}}\cos\left(\frac{\pi}{6} - \theta\right) - \frac{L}{\sqrt{3}}\sin\theta\right)^2 + \left(\frac{\sqrt{3}}{2}R - \frac{L}{\sqrt{3}}\sin\left(\frac{\pi}{6} - \theta\right) - \frac{L}{\sqrt{3}}\cos\theta\right)^2 = L^2$$

$$|B'C'|^2 = \left(\frac{3}{2}R - \frac{L}{\sqrt{3}}\cos\left(\frac{\pi}{6} - \theta\right) - \frac{L}{\sqrt{3}}\cos\left(\frac{\pi}{6} + \theta\right)\right)^2 + \left(\frac{\sqrt{3}}{2}R - \frac{L}{\sqrt{3}}\sin\left(\frac{\pi}{6} - \theta\right) + \frac{L}{\sqrt{3}}\sin\left(\frac{\pi}{6} + \theta\right)\right)^2 = \frac{3}{2}L^2$$

where $R = L + t$

These equations can be rewritten as follows.

$$\sin\theta = \frac{\sqrt{3}}{4} \cdot \frac{R - \sqrt{4L^2 - 3R^2}}{L}$$

$$\sin\theta = \frac{L}{4\sqrt{3}\,R}$$

Accordingly, the following equation is derived.

$$R^2 = \frac{7+3\sqrt{5}}{12}L^2$$

The toner laid-on amount corresponding to the seeping limit can be calculated by substituting this into Equation (6), which will be described below.

$$A_{seeping\ limit} = \frac{2\rho\pi L}{5\sqrt{3}(7+3\sqrt{5})}$$

Here, assuming that gaps are formed between the adjacent toner particles, an laid-on amount $H_{seeping\ limit}$ [μm] and an laid-on amount $A_{seeping\ limit}$ [mg/cm$^2$] are calculated by using the toner particle diameter L [μm] and the toner density ρ [g/cm$^3$] as follows.

$$H_{seeping\ limit} = \frac{4\pi L}{\sqrt{3}(7+3\sqrt{5})} \quad (4)$$

$$A_{seeping\ limit} = \frac{1}{10}\rho H = \frac{2\rho\pi L}{5\sqrt{3}(7+3\sqrt{5})} \quad (5)$$

In FIG. 23, the dotted line shows the relationship between the particle diameter L and the laid-on amount $H_{seeping\ limit}$ obtained from the above equation. It is clear from the graph that the dotted line is on the border between the area in which the image evaluation results are ○ and the area in which the evaluation results are X. Thus, in the evaluation results of the images fixed under Fixing Condition 2 (fixing according to the related art in which no shear force is applied and melting is promoted) shown in FIG. 23, the evaluation results are ○ when the amounts of toners are larger than the seeping limit, which is below the closest-packed arrangement limit, and are X when the amounts of toners are smaller than the seeping limit. Thus, there is a limit condition in obtaining satisfactory color developability by the fixing according to the related art even when the melting condition is sufficient, and it was found that the limit condition is the amount of toner corresponding to the seeping limit.

FIG. 24 is a graph in which the evaluation results of the images fixed under Fixing Condition 3 (fixing according to the present invention in which a shear force is applied) are plotted. Although the evaluation results of the images fixed under Fixing Condition 2 are X in the area below the seeping limit, the images evaluated as ○ can be formed by the fixing device according to the present invention. This is because even when the amounts of toners are below the seeping limit, the toner particles can spread in the in-plane direction and the toner overlapping area can be increased by applying the shear force.

Next, the shear force suitable for achieving the effect of the present invention will be described. The shear force was evaluated by using the above-described dot spread amount. Table 6 shows the results of evaluation of images fixed by changing the laid-on amount of each color and the dot spread amount for each type of toner. The above-described three types of toners No. 1 to No. 3 were used. The laid-on amount for forming a single-color solid image was changed from 0.1 to 0.5 mg/cm$^2$, and unfixed images of single-color and secondary-color solid images, characters, and line drawings were formed. The unfixed images were fixed by the fixing process according to the related art and the fixing process according to the present invention, and the fixed images were evaluated. The fixing process according to the related art is a fixing process of a comparative example which is to be compared with the fixing process according to the present invention and in which the shear force is not applied. With regard to the sliding type (apparatus of the first embodiment), the fixing process according to the related art was performed by using the same apparatus without performing the sliding operation. With regard to the crossing-angle type (apparatus of the second embodiment), the fixing process according to the related art was performed by using the same apparatus without providing the crossing angle. With regard to the peripheral-speed type (apparatus of the third embodiment), the fixing process according to the related art was performed by using the same apparatus without providing a peripheral speed difference.

Table 6 shows the evaluation results of the images formed when the dot spread amount was a little less than 3 μm to a little less than 10 μm.

TABLE 6

| | | | | | | | | | |
|---|---|---|---|---|---|---|---|---|---|
| Toner | No. 1 | | | | | | | | |
| Specific Gravity ρ [g/cm$^3$] | 1.13 | | | | | | | | |
| Particle Diameter L [μm] | 6.8 | | | | | | | | |
| Laid-on Amount A [mg/cm$^2$] | 0.10 | 0.10 | 0.10 | 0.20 | 0.20 | 0.20 | 0.30 | 0.30 | 0.30 |
| Dot Spread Amount [μm] | 5.2 | 8.1 | 9.7 | 5.0 | 7.3 | 8.7 | 4.9 | 7.0 | 8.4 |
| Evaluation Result (Increase of G Saturation) | Δ | Δ | ○ | Δ | ○ | ○ | Δ | ○ | ○ |
| Laid-on Amount A [mg/cm$^2$] | 0.40 | 0.40 | 0.40 | 0.45 | 0.45 | 0.45 | 0.50 | 0.50 | 0.50 |
| Dot Spread Amount [μm] | 3.2 | 5.3 | 6.6 | 3.1 | 4.0 | 5.8 | 2.9 | 4.5 | 7.0 |
| Evaluation Result (Increase of G Saturation) | Δ | ○ | ○ | Δ | Δ | ○ | Δ | Δ | Δ |
| Toner | No. 2 | | | | | | | | |
| Specific Gravity ρ [g/cm$^3$] | 1.24 | | | | | | | | |
| Particle Diameter L [μm] | 6.4 | | | | | | | | |
| Laid-on Amount A [mg/cm$^2$] | 0.10 | 0.10 | 0.10 | 0.20 | 0.20 | 0.20 | 0.30 | 0.30 | 0.30 |
| Dot Spread Amount [μm] | 5.8 | 7.9 | 9.9 | 5.1 | 6.0 | 7.7 | 3.0 | 4.6 | 5.9 |
| Evaluation Result (Increase of G Saturation) | Δ | Δ | ○ | Δ | ○ | ○ | Δ | Δ | ○ |
| Laid-on Amount A [mg/cm$^2$] | 0.40 | 0.40 | 0.40 | 0.45 | 0.45 | 0.45 | 0.50 | 0.50 | 0.50 |
| Dot Spread Amount [μm] | 3.2 | 4.0 | 6.2 | 2.8 | 4.4 | 5.7 | 3.0 | 4.1 | 6.5 |
| Evaluation Result (Increase of G Saturation) | Δ | ○ | ○ | Δ | ○ | ○ | Δ | Δ | Δ |

TABLE 6-continued

| Toner | No. 3 | | | | | | | | |
|---|---|---|---|---|---|---|---|---|---|
| Specific Gravity ρ [g/cm$^3$] | 1.14 | | | | | | | | |
| Particle Diameter L [μm] | 5.8 | | | | | | | | |
| Laid-on Amount A [mg/cm$^2$] | 0.10 | 0.10 | 0.10 | 0.20 | 0.20 | 0.20 | 0.30 | 0.30 | 0.30 |
| Dot Spread Amount [μm] | 5.7 | 7.0 | 8.9 | 3.0 | 4.2 | 6.5 | 3.1 | 4.4 | 5.9 |
| Evaluation Result (Increase of G Saturation) | Δ | ○ | ○ | Δ | Δ | ○ | Δ | ○ | ○ |
| Laid-on Amount A [mg/cm$^2$] | 0.40 | 0.40 | 0.40 | 0.45 | 0.45 | 0.45 | 0.50 | 0.50 | 0.50 |
| Dot Spread Amount [μm] | 2.9 | 4.0 | 6.4 | 3.0 | 4.2 | 5.9 | 3.1 | 4.0 | 6.0 |
| Evaluation Result (Increase of G Saturation) | Δ | Δ | Δ | Δ | Δ | Δ | Δ | Δ | Δ |

○: Saturation of secondary color is increased (1 or more)

Δ: Saturation of secondary color is slightly increased (1 or less) or is substantially maintained X: Sharpness of characters and line drawings is reduced The dot spread amount can be changed by changing the fixing temperature or fixing time in the fixing device according to the present invention. As the fixing temperature increases, the toner viscosity decreases so that the amount by which the toners are spread by the shear force increases. As a result, the dot spread amount increases. As the fixing time increases, the time for which the shear force is applied increases so that the amount by which the toners are spread by the shear force increases. As a result, the dot spread amount increases.

In the table, ○ shows that the saturation of the secondary color (green) formed by the fixing process according to the present invention is increased by 1 or more compared to that of the image formed by the fixing process according to the related art (no shear force is applied), which is a comparative example, and Δ shows that the saturation of the secondary color is increased only by a small amount or is substantially maintained.

Figure 31:
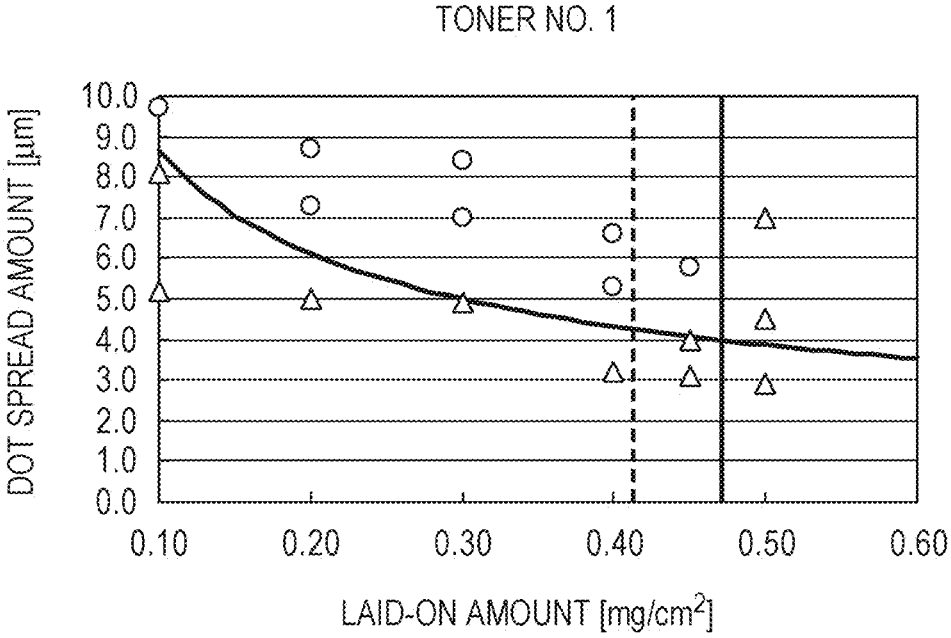
FIG. 31 is a graph showing the results of evaluation of color developability with respect to the dot spread amount of toner No. 1.
Figure 32:
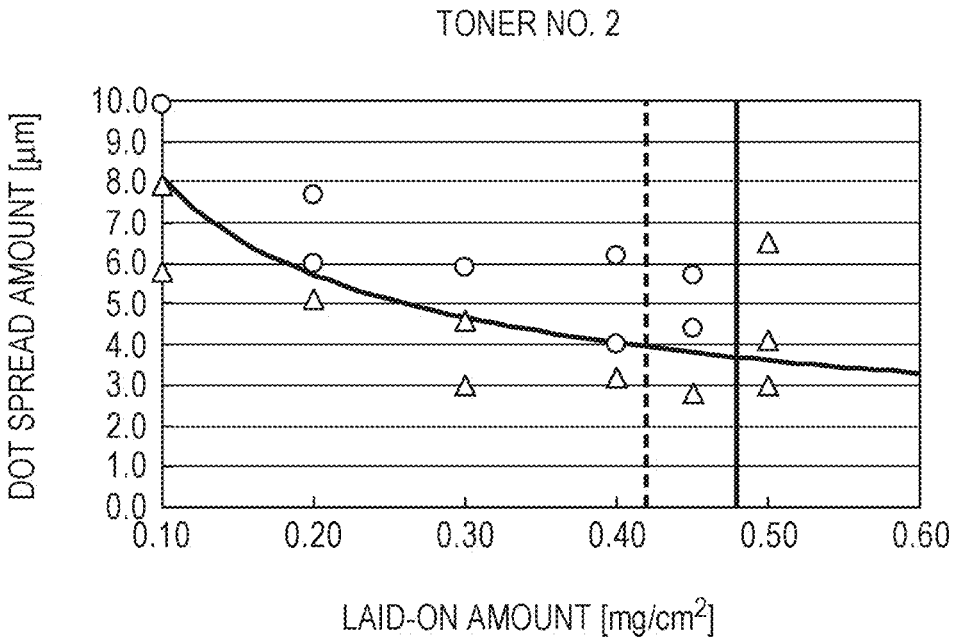
FIG. 32 is a graph showing the results of evaluation of color developability with respect to the dot spread amount of toner No. 2.
Figure 33:
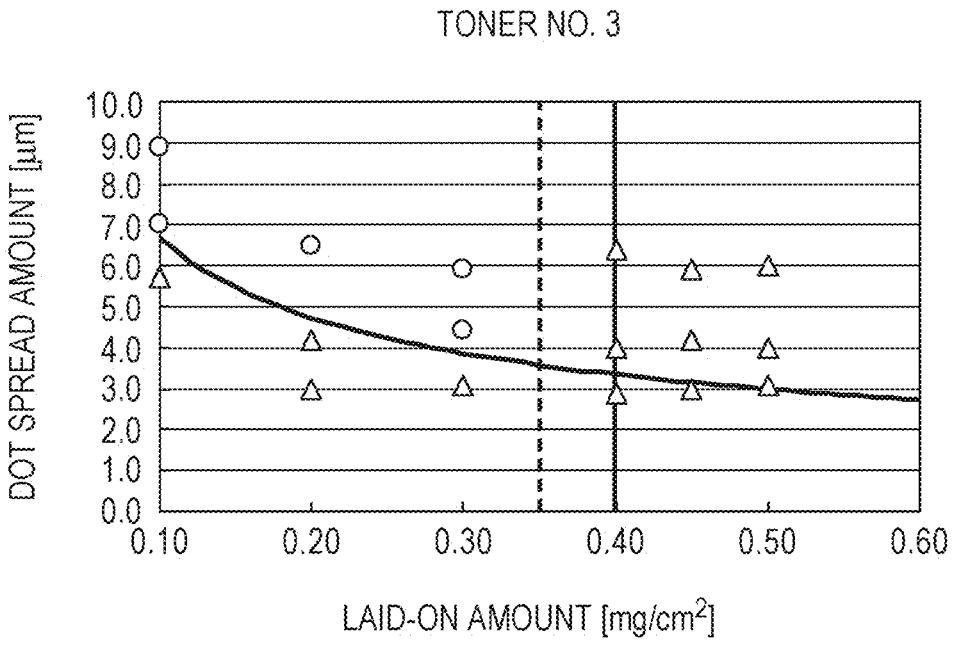
FIG. 33 is a graph showing the results of evaluation of color developability with respect to the dot spread amount of toner No. 3.

To facilitate understanding of Table 6, FIGS. 31, 32, and 33 show graphs in which the evaluation results of the images are plotted for each type of toner. The horizontal axis represents the laid-on amount [mg/cm$^2$], and the vertical axis represents the dot spread amount [μm]. The solid and dashed vertical lines in the graphs show the closest-packed arrangement limit and the seeping limit of the toners calculated from Equations (3) and (5), respectively. In each of FIGS. 31, 32, and 33, which show the respective types of toners, the image evaluation results are Δ when the amounts of toners are larger than the closest-packed arrangement limit (vertical solid line). This is because when the amounts of toners are large, the overlapping area of the secondary color is also large and high saturation can be obtained even by the fixing process according to the related art. In this case, the difference between the fixing process according to the present invention and the fixing process according to the related art is small. When the amounts of toners are smaller than the closest-packed arrangement limit (vertical solid line) and larger than the seeping limit (vertical dashed line), high saturation can be obtained even by the fixing process according to the related art if the condition is such that the toners can be sufficiently melted. Therefore, the difference between the fixing process according to the present invention and the fixing process according to the related art is small and the image evaluation results are Δ in some cases. When the amounts of toners are smaller than the seeping limit, high saturation cannot be obtained by the fixing process according to the related art and the effect of the present invention is significant. In this case, it is clear from the graphs that to make the image evaluation results ○, it is necessary to increase the dot spread amount as the amounts of toners decrease. The distribution of ○ and Δ in FIGS. 31, 32, and 33 implies that there is a lower limit to the dot spread amount necessary to reliably achieve the effect of the present invention, the lower limit varying in accordance with the amount of toner.

Figure 27B:
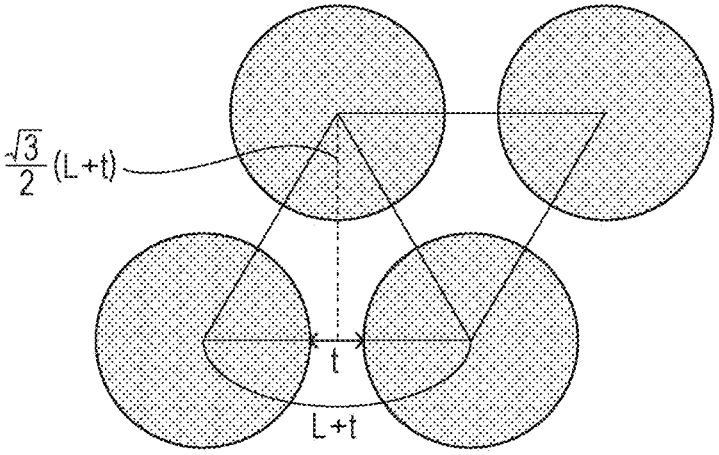
Figure 34:
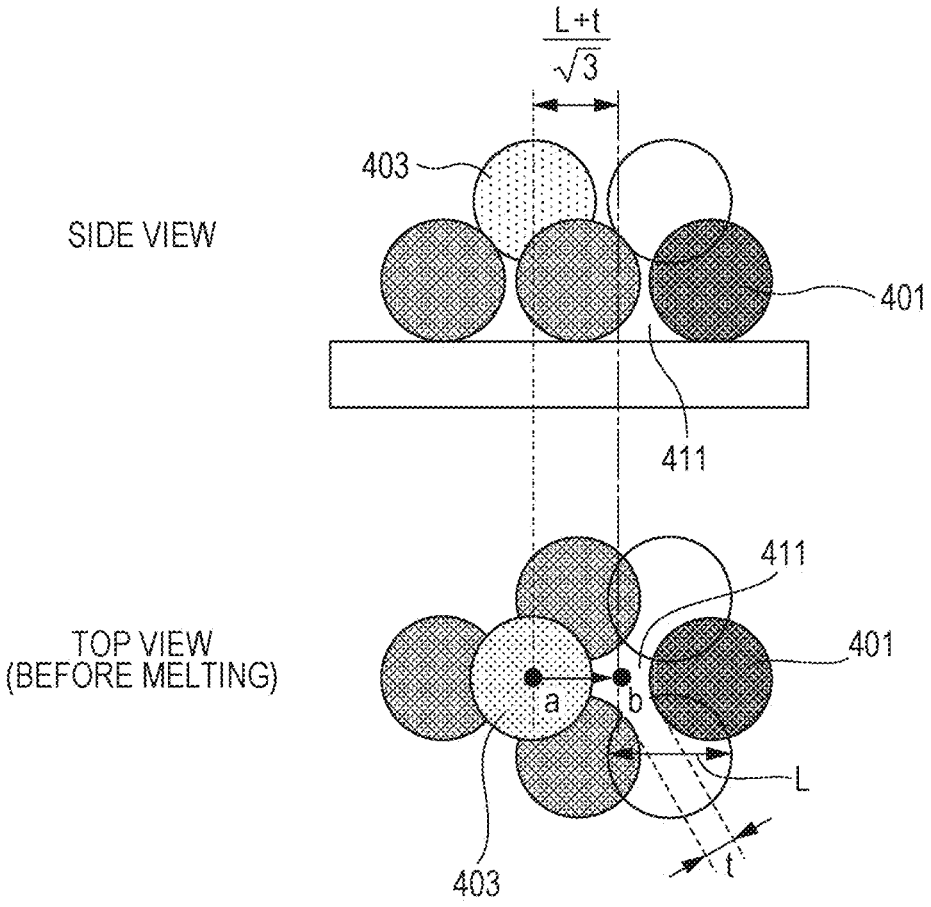
FIG. 34 illustrates a model for studying a lower limit of the dot spread amount.

To study the lower limit of the dot spread amount, assuming that spherical toner particles are arranged with constant gaps t [μm] (distance of closest approach) therebetween, the dot spread amount necessary to increase the saturation was calculated. FIG. 34 and FIG. 27B show calculation models. A single upper-layer toner particle 403 is considered, and a distance by which the toner particle 403 is required to spread to overlap a single lower-layer toner particle (401 in FIG. 34), which is a closest one of the lower-layer toner particles that do not overlap the toner particle 403 in the unfixed state, is defined as the lower limit of the dot spread amount. The distance between the center position a of the upper-layer toner particle 403 and the center b of the gap 411 adjacent to the upper-layer toner particle 403 can be calculated as $(L+t)/\sqrt{3}$. When the toner particle 403 spreads in the direction from the position a to the position b by an amount such that the center a of the toner particle 403 moves to the center b of the gap 411, the toner particles 403 and 401 overlap and the saturation can be increased. In the state in which spherical toner particles are arranged with constant gaps t [μm] (distance of closest approach) therebetween, the relationship between the toner laid-on amount A [mg/cm$^2$] of each toner, the density ρ [g/cm$^3$], the particle diameter L [μm], and the gaps t [μm] is as follows.

$$A = \frac{\rho\pi L^3}{30\sqrt{3}\,(L+t)^2} \tag{6}$$

Equation (6) can be derived by the same method as that used to derive Equation (3) that shows the toner laid-on amount in the closest-packed arrangement in which the gaps t are zero. The distance between a and b ($(L+t)/\sqrt{3}$) can be calculated from the above equation as follows.

$$\frac{(L+t)}{\sqrt{3}} = \sqrt{\frac{\rho\pi L^3}{90\sqrt{3}\,A}} \tag{7}$$

The curves shown in FIGS. 31, 32, and 33 show the relationship between the laid-on amount A [mg/cm$^2$] of Equation (6) and the distance calculated from Equation (7). It is clear that the evaluation results of the images formed by toners No. 1, No. 2, and No. 3 are divided into ○ and Δ across the curves defined by Equation (7). Thus, the distance defined by Equation (7) can be considered as the lower limit of the dot spread amount necessary to obtain sufficient saturation.

As described above, in the case where an image is formed by using toners of a plurality of colors, when the weight average particle diameter of each toner is L (μm), the specific gravity of each toner is ρ (g/cm$^3$), and the toner laid-on amount (laid-on amount of each color) is A (mg/cm$^2$), a fixing unit preferably applies a shear force so that the dot spread amount (μm) of the toner image satisfies the following condition.

$$\sqrt{\frac{\rho\pi L^3}{90\sqrt{3}\cdot A}} \leq \text{Dot Spread Amount} \tag{8}$$

The above-described fixing unit that applies the shear force may be installed in an image forming apparatus that forms an unfixed toner image on a recording material so that a certain condition is satisfied. That is, when the weight average particle diameter of each toner is L (μm) and the specific gravity of each toner is ρ (g/cm$^3$), the maximum toner laid-on amount A (mg/cm$^2$) of each color in the case where an image is formed by using toners of a plurality of colors may satisfy the following condition.

$$A < \frac{\rho\pi L}{30\sqrt{3}} \tag{9}$$

In such a case, the effect of the present invention can be increased.

The above-described fixing device that applies the shear force may also be installed in an image forming apparatus that forms an unfixed toner image on a recording material so that the maximum toner laid-on amount A (mg/cm$^2$) of each color satisfies the following condition.

$$A < \frac{2\rho\pi L}{5\sqrt{3}(7+3\sqrt{5})} \tag{10}$$

In such a case, the effect of the present invention can be further increased.

With regard to the upper limit of the dot spread amount, the effect of increasing the saturation of the secondary color was obtained when the dot spread amount was increased up to about 30 μm. As illustrated in FIG. 3, the saturation of the secondary color increases as the dot spread amount increases. In particular, when the laid-on amount and the overlapping area of the toners that form the secondary color are small, the overlapping area can be greatly increased even when the dot spread amount is small. Therefore, sufficient saturation increasing effect can be obtained. When the laid-on amount is large, the overlapping area of the toners that form the secondary color is large in the unfixed state. Therefore, the amount of increase of the saturation relative to the increase of the dot spread amount is small.

When the dot spread amount was more than 30 μm, the effect of increasing the saturation of the secondary color was reduced. When the toners were further spread, the sharpness of the characters and line drawings was reduced. This is because the edge portions of the images were nonuniformly and excessively spread and blurred. Therefore, the dot spread amount is preferably set to 30 μm or less.

More preferably, the dot spread amount (μm) preferably satisfies the following condition.

$$\sqrt{\frac{\rho\pi L^3}{90\sqrt{3}\cdot A}} \leq \text{Dot Spread Amount} \leq 30\ \mu\text{m} \tag{11}$$

Fixing Device According to Fourth Embodiment

Figure 35:
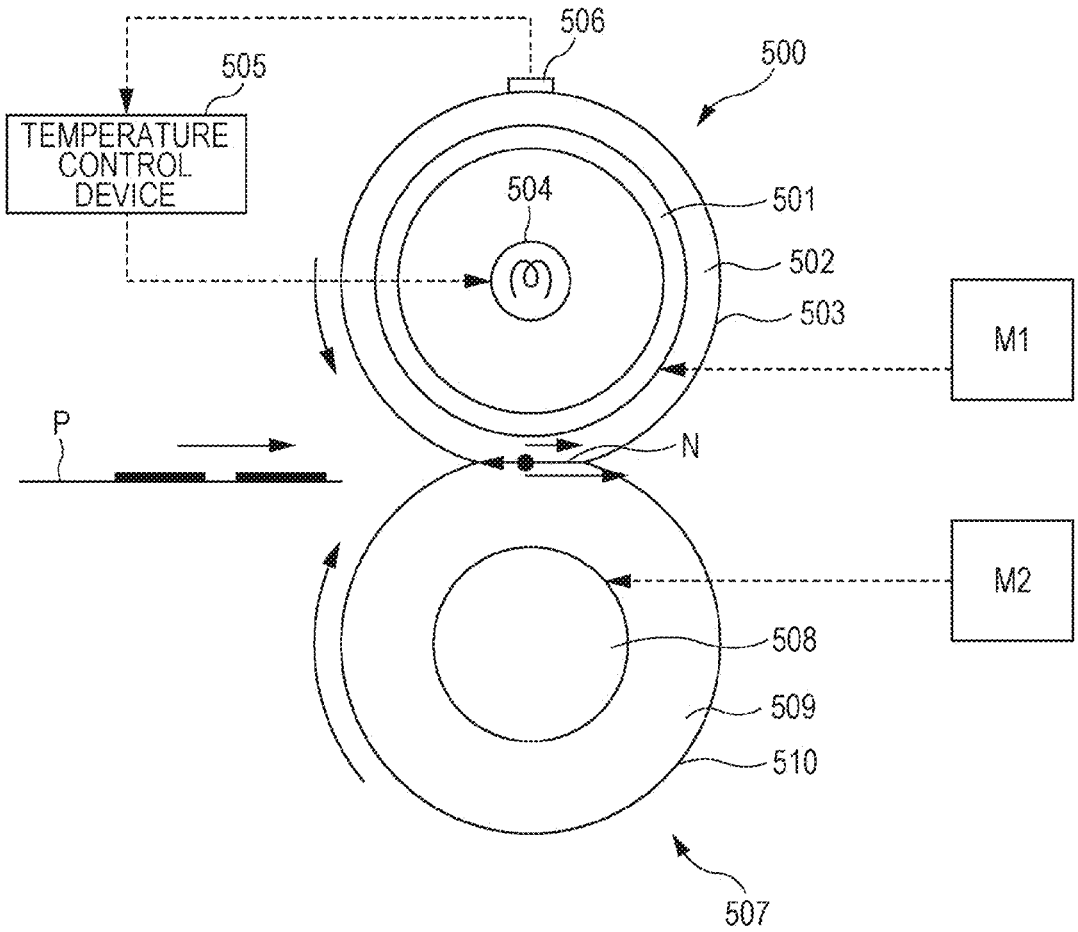
FIG. 35 is a schematic sectional view of a fixing device according to a fourth embodiment.

FIG. 35 is a schematic sectional view of a fixing device according to a fourth embodiment. The fixing device includes a heating roller (first rotating member) 500 that is rotatable and has a heat source 504 and a pressing roller (second rotating member) 507 that is rotatable and pressed against the heating roller 500 so as to form a fixing nip portion. A sheet of recording paper P that carries toner T is nipped and conveyed through the fixing nip portion N. At the same time, an unfixed toner image is heated and compressed so that the unfixed toner image is fixed to the sheet of recording paper P.

The heating roller 500 includes a hollow core bar 501 made of a metal (aluminum, iron, etc.) having a high thermal conductivity, an elastic layer 502 that is made of, for example, a silicone rubber and provided around the core bar 501, and a low-hardness release layer 503 that covers the surface of the elastic layer 502. Thus, the flexibility of the surface layer of the heating roller 500 is increased. The low-hardness release layer 503 may be made of, for example, an oil-impregnated silicone rubber or a fluorocarbon rubber, such as binary vinylidene fluoride rubber, ternary vinylidene fluoride rubber, tetrafluoroethylene-propylene rubber, or fluorophosphazene rubber, which are used alone or in combination. In the present embodiment, an oil-impregnated silicone rubber is used. A halogen heater 504 is disposed in the hollow core bar 501 as the heat source. The operation of the halogen heater 504 is controlled by a temperature control device 505. The temperature control device 505 performs an output control for controlling the operation of the halogen heater 504 on the basis of the surface temperature of the heating roller 500 detected by a thermister 506.

According to the present embodiment, the flexibility of the surface layer of the heating roller is increased so that the surface layer is capable of following projections and recesses on the sheet of paper. Therefore, the effect obtained by applying the shear force according to the first to third embodiments can be more reliably achieved.

The hardness of the low-hardness release layer 503 will now be described. A microrubber hardness meter MD-1 Type A (hereinafter referred to as MD-1 hardness meter) manufactured by Kobunshi Keiki Co., Ltd. was used to measure a MD-1 hardness. The reason why this measurement device was used will now be described.

In the present embodiment, the effect is largely influenced by the surface hardness of the fixing member. Therefore, the MD-1 hardness meter, which is suitable for measuring the surface hardness, was used. A value approximate to the JIS-A hardness according to JIS K 6301 can be obtained by the hardness meter MD-1 Type A.

Figure 36A:
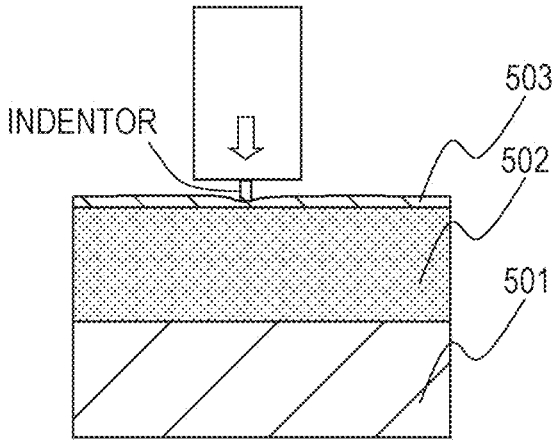
FIGS. 36A and 36B are schematic sectional views of a heating roller in the process of measuring the hardness of a release layer according to the fourth embodiment.
Figure 36B:
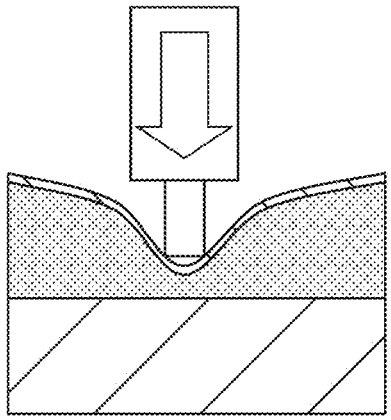

FIGS. 36A and 36B shows schematic sectional views illustrating the process of measuring the hardness of the surface layer of the heating roller 500. FIG. 36A illustrates the case in which the MD-1 hardness meter is used and FIG. 36B illustrates the case in which a rubber hardness meter other than the MD-1 hardness meter is used. The MD-1 hardness meter performs a hardness measurement by pressing a small indentor into a measurement object by a small amount. Therefore, the hardness of only a part of the measurement object near the surface thereof is measured.

The rubber hardness meter other than the MD-1 hardness meter uses a larger indentor and presses the indentor into the measurement object by a larger amount compared to the MD-1 hardness meter. Therefore, the measurement result is affected by the material of the layer under the measurement object. For example, when the elastic layer 502 is significantly softer than the release layer 503, which is the surface layer, and the indentor is pressed into the release layer 503 so that the elastic layer 502 is largely deformed, there is a possibility that the output hardness will be smaller than the hardness of the area near the surface layer. When the indentor is further pressed into the release layer 503, the measurement result may be affected by the core bar 501, which is the innermost layer, and there is a possibility that the output hardness will be larger than the hardness of the area near the surface layer.

A method for applying a shear force according to the present embodiment will now be described. In the present embodiment, similar to the third embodiment, the rotation speeds of the heating roller 500 and the pressing roller 507 are set to different values (a peripheral speed difference is provided) so that a shear force is applied in the fixing nip portion N. With regard to a fixing operation condition according to the present embodiment, the rotation speed of the pressing roller 507 is set to 91.0 mm/sec, and the rotation speed of the heating roller 500 is set to 90.5 mm/sec (about 0.5% lower than the rotation speed of the heating roller). In this case, in a period during which the recording material P passes through the fixing nip portion N having a width of about 6 mm, the heating roller 500 slides along the pressing roller 507 by about 30 μm. In this period, the recording material P also slides along the fixing member while being conveyed.

To confirm the effect of the present embodiment, a comparative experiment was performed using two types of release layers having different MD-1 hardnesses. In the fixing roller 501 according to the present embodiment, the cylindrical core bar is made of aluminum and has a diameter of 55 mm, a thickness of 7 mm, and an inner diameter of 41 mm. The elastic layer, which is provided around the outer periphery of the core bar, is made of a silicone rubber and has a JIS-A hardness of 50° and a thickness of 2.5 mm. The comparative experiment was performed by forming a low-hardness release layer A on the outer periphery of the elastic layer. The low-hardness release layer A was made of an oil-impregnated silicone rubber and had a JIS-A hardness of 27° and a thickness of 250 μm. For comparison, a release layer B was also formed on the elastic layer. The release layer B was formed of a tube made of PFA and had a thickness of 50 μm. The MD-1 hardnesses of the release layers A and B were measured and found to be 38 and 72, respectively.

Saturations of patches in green, which is a secondary color, formed by the fixing process in which the fixing roller and the pressing roller were rotated without a peripheral speed difference therebetween (peripheral speed difference was 0%), and saturations of green patches formed by the fixing process in which the fixing roller was rotated at a rotation speed that is 0.5% lower than that of the pressing roller (peripheral speed difference was 0.5%), were measured by using a spectral densitometer manufactured by X-Rite, Inc. Table 7 shows the amount Δc* by which the saturation c* was increased from that obtained when the peripheral speed difference was 0% to that obtained when the peripheral speed difference was 0.5%.

TABLE 7

| | Release Layer A | Release Layer B |
|---|---|---|
| Δc* | 3.0 | 1.3 |

The dot spread amount was about 2 μm in both of the cases in which the low-hardness release layer A was used and the high-hardness release layer B was used. Although the dot spread amount was constant, the effect of the shear force was increased by using the low-hardness release layer A instead of the high-hardness release layer B.

Figure 37A:
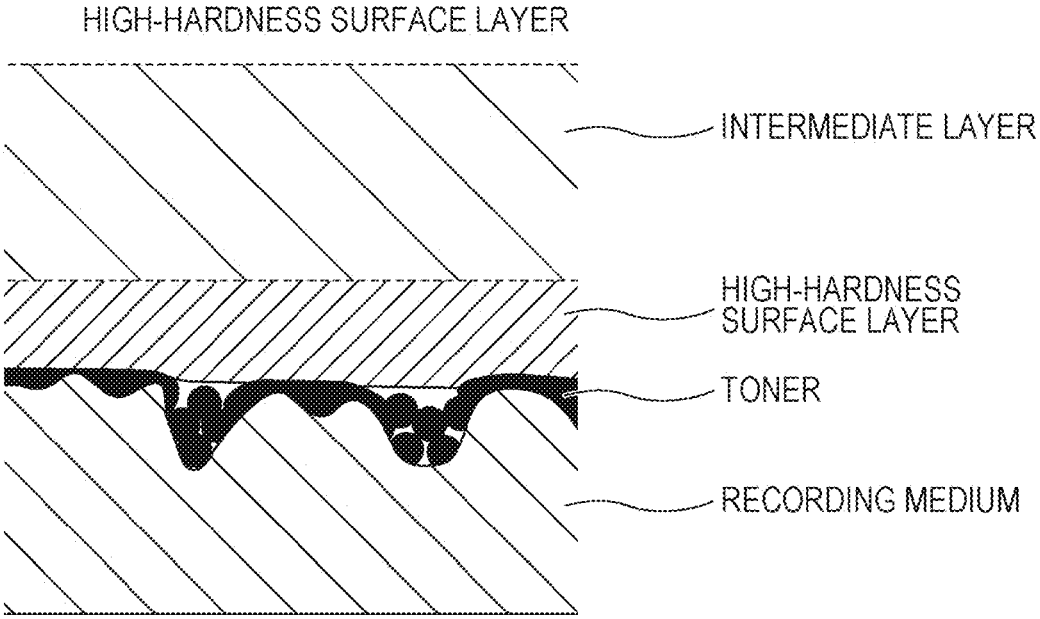
FIGS. 37A and 37B are schematic diagrams illustrating the states of a fixing nip portion in a fixing process performed by the fixing device according to the fourth embodiment.

The reason why the amount of increase of the saturation was changed depending on the hardness of the surface layer will be described with reference to FIGS. 37A and 37B. When the high-hardness release layer B is used, as illustrated in FIG. 37A, the release layer B comes into contact with the toner particles on the projections of the recording material (hereinafter referred to simply as projections). However, the release layer B sometimes cannot sufficiently follow the projections and recesses on the recording material and cannot come into sufficient contact with the toner particles in the recesses of the recording material (hereinafter referred to simply as recesses). When the shear force is applied to the toner image in this state, although the shear force can be applied to portions of the toner image on the projections, the shear force sometimes cannot be sufficiently applied to portions of the toner image in the recesses.

Figure 37B:
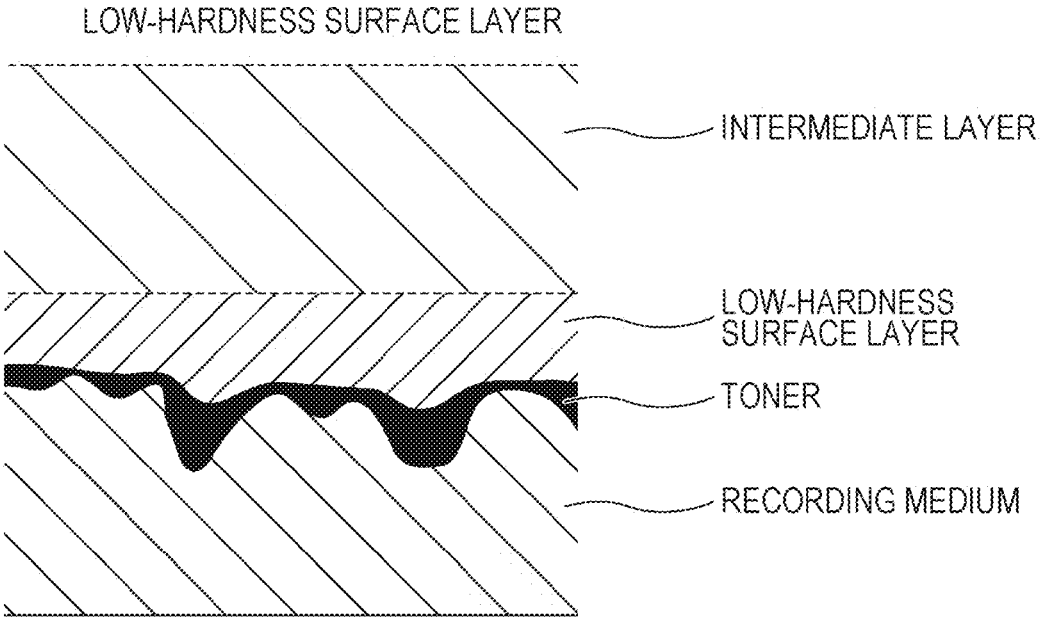

When the low-hardness release layer A is used, as illustrated in FIG. 37B, the release layer A is deformed so as to follow the projections and recesses on the recording material, and comes into uniform contact with the toner particles on the projections and in the recesses. When the shear force is applied to the toner image in this state, the portions of the toner image on the projections and the portions of the toner image in the recesses can both be spread. As a result, the color developability can be increased.

Next, the recording material will be explained. In the present embodiment, OK prince high quality paper manufactured by Oji paper Co., Ltd. is used as an example of a recording material whose projections and recesses affect the image quality, such as the color developability. The basis weight of this recording material is 81 g/m$^2$. The average dimension of the projections and recesses on the recording material is about 10 μm, and the pitch of the projections and recesses is about several tens of micrometers. It was found that when the MD-1 hardness of the release layer of the fixing roller is 70 or less, the release layer can follow the projections and recesses on the recording material.

When the release layer is made of a material (for example, PFA) having an MD-1 hardness that is higher than 70, the release layer can only slightly follow the projections and recesses on the recording material even when the hardness of the intermediate layer formed thereunder (the elastic layer 502 in the present embodiment) is reduced. Therefore, it is difficult to spread the portions of the toner image in the recesses. It is difficult to use a release layer made of a material (for example, a type of a rubber member) having an MD-1 hardness that is lower than 20 from the viewpoint of durability. Therefore, in consideration of the case in which a color image is formed on a recording material having large projections and recesses, such as a sheet of normal paper, the MD-1 hardness of the surface layer of the fixing roller (first rotating member) is preferably in the range of 20 or more and 70 or less.

The thickness of the low-hardness release layer is preferably 20 μm or more. This is because the thickness of pulp fibers that form the projections and recesses on the recording material is around 20 μm, and the thickness of 20 μm or more is required for the low-hardness release layer to be deformed so as to follow the projections and recesses of the above-described size and pitch. The hardness of the intermediate layer (the elastic layer 502 in the present embodiment) formed under the release layer is not particularly limited as long as the intermediate layer is not excessively deformed when the pressing force is applied and the pressing force can be transmitted to the surface layer. Preferably, the hardness of the intermediate layer is 20 or more. Even when the intermediate layer has a high hardness such as that of a metal, the followability with respect to the projections and recesses on the recording material can be adjusted only by the deformation of the release layer.

The effect of increasing the color developability is influenced mainly by the toner laid-on amount per unit area of the image, the fixing condition, and the recording material. The effect of increasing the color developability according to the present invention is particularly increased when the toner laid-on amount is small and the overlapping area in which toners of different colors overlap is small in the unfixed state. When the fixing member includes a release layer having an MD-1 hardness of 70 or less, portions of the toner image in the recesses in the surface of the recording material can be spread and the effect of increasing the color developability obtained by applying the shear force can be further increased.

As described above, the fixing device according to the present embodiment includes a first rotating member and a second rotating member. The first rotating member includes a low-hardness release layer that comes into contact with portions of the unfixed toner image that are disposed in the recesses of the recording material. The second rotating member rotates at a peripheral speed that differs from that of the first rotating member and forms the fixing nip portion together with the first rotating member. While a single recording material is being subjected to the fixing process in the fixing nip portion, a shear force is continuously applied in a constant direction not only to toner particles on the projections of the recording material but also to toner particles in the recesses in the recording material. Therefore, the saturation can be increased even when the toner laid-on amount of the image is small.

The present invention is not limited to the above-described embodiments, and various alterations and modifications are possible without departing from the spirit and scope of the present invention. Therefore, the following claims are appended to define the scope of the present invention.

What is claimed is:

1. An image forming apparatus, comprising:

an image forming unit that forms an unfixed toner image, in which toners of a plurality of colors are stacked, on a recording material; and a fixing unit that fixes the unfixed toner image formed on the recording material to the recording material by heating and pressing the unfixed toner image in a fixing nip portion, wherein, in a case where an image is formed by using the toners of the plurality of colors, when a specific gravity of the toners is ρ (g/cm$^3$) and a weight average particle diameter of the toners is L (μm), the image forming unit sets a maximum laid-on amount A (mg/cm$^2$) of each color in the unfixed toner image on the recording material so as to satisfy the following condition:

$$A < \frac{\rho\pi L}{30\sqrt{3}},$$

and wherein the fixing unit fixes the unfixed toner image to the recording material so that a dot spread amount (μm) of the toner image satisfies the following condition:

$$\sqrt{\frac{\rho\pi L^3}{90\sqrt{3}\cdot A}} \leq \text{Dot Spread Amount}$$

2. The image forming apparatus according to claim 1, wherein, in the case where an image is formed by using the toners of the plurality of colors, the image forming unit sets the maximum laid-on amount A (mg/cm$^2$) of each color so as to satisfy the following condition:

$$A < \frac{2\rho\pi L}{5\sqrt{3}\left(7+3\sqrt{5}\right)}.$$

3. The image forming apparatus according to claim 1, wherein, while a single recording material is being subjected to the fixing process in the fixing nip portion, the fixing unit continuously applies a pressure to the fixing nip portion so that the dot spread amount (μm) satisfies the condition of the dot spread amount according to claim 1.

4. The image forming apparatus according to claim 3, wherein, while the single recording material is being subjected to the fixing process in the fixing nip portion, the fixing unit continuously applies the pressure to the fixing nip portion so that the dot spread amount (μm) satisfies the following condition:

$$\sqrt{\frac{\rho\pi L^3}{90\sqrt{3}\cdot A}} \leq \text{Dot Spread Amount} \leq 30\ \mu\text{m}.$$

5. The image forming apparatus according to claim 1, wherein the fixing unit includes a first rotating member that comes into contact with the unfixed toner image and a second rotating member that forms the fixing nip portion together with the first rotating member, and wherein at least one of the first rotating member and the second rotating member continuously slides in a predetermined direction that differs from a rotation direction while a single recording material is being subjected to the fixing process in the fixing nip portion.

6. The image forming apparatus according to claim 1, wherein the fixing unit includes a first rotating member that comes into contact with the unfixed toner image and a second rotating member that has a crossing angle with respect to the first rotating member and that forms the fixing nip portion together with the first rotating member.

7. The image forming apparatus according to claim 1, wherein the fixing unit includes a first rotating member that comes into contact with the unfixed toner image and a second rotating member that rotates at a peripheral speed that differs from a peripheral speed of the first rotating member and that forms the fixing nip portion together with the first rotating member.

8. The image forming apparatus according to claim 5, wherein a coefficient of friction between the first rotating member and the recording material is smaller than a coefficient of friction between the second rotating member and the recording material.

9. The image forming apparatus according to claim 6, wherein a coefficient of friction between the first rotating member and the recording material is smaller than a coefficient of friction between the second rotating member and the recording material.

10. The image forming apparatus according to claim 7, wherein a coefficient of friction between the first rotating member and the recording material is smaller than a coefficient of friction between the second rotating member and the recording material.

11. The image forming apparatus according to claim 5, wherein the first rotating member includes a release layer having an MD-1 hardness in the range of 20 or more and 70 or less.

12. The image forming apparatus according to claim 11, wherein the release layer has a thickness of 20 μm or more.

13. The image forming apparatus according to claim 6, wherein the first rotating member includes a release layer having an MD-1 hardness in the range of 20 or more and 70 or less.

14. The image forming apparatus according to claim 13, wherein the release layer has a thickness of 20 μm or more.

15. The image forming apparatus according to claim 7, wherein the first rotating member includes a release layer having an MD-1 hardness in the range of 20 or more and 70 or less.

16. The image forming apparatus according to claim 15, wherein the release layer has a thickness of 20 μm or more.

* * * * *